US011264754B2

(12) United States Patent
Sathianathan et al.

(10) Patent No.: US 11,264,754 B2
(45) Date of Patent: Mar. 1, 2022

(54) ELECTRICAL TERMINAL AND CONNECTOR ASSEMBLY

(71) Applicant: Molex, LLC, Lisle, IL (US)

(72) Inventors: Dwaraganathan Bhagyanathan Sathianathan, Rochester Hills, MI (US); Yves Lepottier, Ann Arbor, MI (US)

(73) Assignee: Molex, LLC, Lisle, IL (US)

( * ) Notice: Subject to any disclaimer, the term of this patent is extended or adjusted under 35 U.S.C. 154(b) by 400 days.

(21) Appl. No.: 16/473,624

(22) PCT Filed: Mar. 1, 2018

(86) PCT No.: PCT/US2018/020416
§ 371 (c)(1),
(2) Date: Jun. 26, 2019

(87) PCT Pub. No.: WO2018/160814
PCT Pub. Date: Sep. 7, 2018

(65) Prior Publication Data

US 2021/0288430 A1 Sep. 16, 2021

Related U.S. Application Data

(60) Provisional application No. 62/465,355, filed on Mar. 1, 2017.

(51) Int. Cl.
*H01R 13/422* (2006.01)
*H01R 4/18* (2006.01)
(Continued)

(52) U.S. Cl.
CPC ..... *H01R 13/4223* (2013.01); *H01R 4/185* (2013.01); *H01R 13/113* (2013.01);
(Continued)

(58) Field of Classification Search
CPC .. H01R 4/185; H01R 13/4223; H01R 13/113; H01R 13/18; H01R 13/17;
(Continued)

(56) References Cited

U.S. PATENT DOCUMENTS 3,363,224 A 1/1968 Harlan et al.
4,708,416 A 11/1987 Awano
(Continued)

FOREIGN PATENT DOCUMENTS

CN 1183658 A 6/1998
CN 202855982 A 4/2013
(Continued)

OTHER PUBLICATIONS

Notification of Reasons for Refusal received for KR application No. 10-2019-7025064, dated Dec. 28, 2020, 20 pages. (11 pages of English translation and 9 pages of official copy).
(Continued)

*Primary Examiner* — Marcus E Harcum

(57) ABSTRACT

In some embodiments, an electrical terminal includes a contact formed and a hood surrounding the contact. The contact and hood have cooperating retention features for securing the contact to the hood, and the hood provides strengthening features for improving the mechanical properties of the contact. The electrical terminal is mounted in a connector assembly. The electrical terminal has features which prevent or minimize damage to a seal of the connector assembly.

23 Claims, 36 Drawing Sheets

(51) Int. Cl.
*H01R 13/11* (2006.01)
*H01R 13/52* (2006.01)
*H01R 13/627* (2006.01)
*H01R 43/16* (2006.01)

(52) U.S. Cl.
CPC ..... *H01R 13/5202* (2013.01); *H01R 13/627* (2013.01); *H01R 43/16* (2013.01); *H01R 2201/26* (2013.01)

(58) Field of Classification Search
CPC .. H01R 13/5202; H01R 13/627; H01R 43/16; H01R 2201/26
USPC ..... 439/851, 852, 856, 845, 752, 752.2
See application file for complete search history.

(56) References Cited

U.S. PATENT DOCUMENTS 4,734,064 A * 3/1988 Knapp ..... H01R 43/16 439/852
4,900,271 A * 2/1990 Colleran ..... H01R 13/113 439/275
5,281,168 A * 1/1994 Krehbiel ..... H01R 13/4362 439/595
5,286,221 A * 2/1994 Fencl ..... H01R 13/7195 439/607.53
5,437,566 A * 8/1995 Zinn ..... H01R 13/113 439/839
5,468,163 A * 11/1995 Egenolf ..... H01R 13/7032 439/839
5,533,914 A * 7/1996 Sawada ..... H01R 13/187 439/843
5,607,328 A * 3/1997 Joly ..... H01R 13/11 439/851
5,667,413 A * 9/1997 Trafton ..... H01R 13/187 439/271
5,755,599 A * 5/1998 Hotea ..... H01R 13/18 439/745
5,839,925 A 11/1998 Simmons
5,921,822 A * 7/1999 Kennedy ..... H01R 13/187 439/851
5,951,336 A * 9/1999 Seko ..... H01R 13/432 439/745
5,951,338 A * 9/1999 Seko ..... H01R 13/18 439/843
5,975,964 A * 11/1999 Seko ..... H01R 13/18 439/857
6,386,928 B2 * 5/2002 Kitamura ..... H01R 13/113 439/852
6,394,858 B1 * 5/2002 Geltsch ..... H01R 13/114 439/852
6,439,935 B2 * 8/2002 Saka ..... H01R 13/113 439/842
6,475,040 B1 11/2002 Myer et al.
6,478,635 B2 * 11/2002 Charles ..... H01R 4/185 439/851
6,672,910 B2 * 1/2004 Hotea ..... H01R 13/4223 439/843
6,872,103 B1 * 3/2005 Flieger ..... H01R 13/18 439/839
6,905,376 B2 * 6/2005 Chen ..... H01R 13/04 439/595
6,945,830 B2 * 9/2005 Copper ..... H01R 13/057 439/748
7,014,515 B2 * 3/2006 Lutsch ..... H01R 13/113 439/843
D553,080 S 10/2007 Sakamaki et al.
D556,136 S 11/2007 Shiga et al.
7,300,319 B2 * 11/2007 Lutsch ..... H01R 4/185 439/845
7,419,410 B2 * 9/2008 Myer ..... H01R 13/113 439/852
7,419,411 B2 * 9/2008 Kaneko ..... H01R 13/113 439/851
7,458,863 B2 * 12/2008 Shimizu ..... H01R 43/16 439/842
7,503,813 B1 * 3/2009 Osterhart ..... H01R 13/113 439/852
7,530,859 B2 * 5/2009 Moll ..... H01R 4/185 439/852
7,594,832 B2 9/2009 Oka et al.
D603,804 S 11/2009 Urano
D621,368 S 8/2010 Lee et al.
7,976,351 B2 7/2011 Boemmel et al.
7,976,353 B2 7/2011 Myer
7,988,505 B2 * 8/2011 Hotea ..... H01R 13/187 439/852
8,858,274 B2 * 10/2014 Jakoplic ..... H01R 13/11 439/877
D725,046 S 3/2015 Kuo
9,011,186 B2 * 4/2015 Wirth ..... H01R 13/112 439/852
9,118,131 B2 * 8/2015 Jakoplic ..... H01R 13/113
9,160,082 B2 * 10/2015 Heringhaus ..... H01R 13/193
D751,041 S 3/2016 Ebisawa et al.
D751,042 S 3/2016 Ebisawa et al.
D762,587 S 8/2016 Ebisawa et al.
D781,239 S 3/2017 Ikeda et al.
9,666,957 B2 * 5/2017 Endo ..... H01R 4/48
D813,817 S 3/2018 Kataoka
D827,576 S 9/2018 Sugizaki
D847,759 S 5/2019 Bhagyanathan et al.
10,297,940 B2 * 5/2019 Tanikawa ..... H01R 13/4223
10,862,226 B2 * 12/2020 Mochizuki ..... H01R 4/4818
11,152,730 B2 * 10/2021 Nishii ..... H01R 4/185
2002/0002011 A1 1/2002 Shirouzu et al.
2002/0076999 A1 * 6/2002 Chen ..... H01R 13/187 439/851
2004/0127107 A1 * 7/2004 Lischeck ..... H01R 13/18 439/851
2005/0014422 A1 * 1/2005 Patel ..... H01R 13/114 439/851
2005/0118891 A1 * 6/2005 Chen ..... H01R 13/187 439/851
2005/0176298 A1 * 8/2005 Flowers ..... H01R 13/4365 439/595
2006/0035538 A1 2/2006 Suemitsu et al.
2006/0040533 A1 * 2/2006 Koshy ..... H01R 13/62977 439/157
2006/0292937 A1 * 12/2006 Morello ..... H01R 13/113 439/856
2008/0070452 A1 * 3/2008 Komiyama ..... H01R 13/113 439/852
2009/0075530 A1 * 3/2009 Schneider ..... H01R 4/185 439/834
2010/0173539 A1 * 7/2010 Furutani ..... H01R 4/185 439/852
2012/0142233 A1 * 6/2012 Blasko ..... H01R 13/113 439/852
2012/0196488 A1 8/2012 Su et al.
2012/0225574 A1 9/2012 Nakamura
2013/0273790 A1 * 10/2013 Jakoplic ..... H01R 13/17 439/891
2013/0323949 A1 12/2013 De Dios Martin et al.
2014/0242824 A1 * 8/2014 Karadimas ..... H01R 13/53 439/181
2014/0302702 A1 * 10/2014 Germ ..... H01R 13/639 439/370
2015/0118902 A1 * 4/2015 Data ..... H01R 13/6315 439/587
2015/0155670 A1 * 6/2015 Gardner ..... H01R 13/5208 439/587
2016/0028169 A1 * 1/2016 Glick ..... H01R 13/18 439/816
2016/0072203 A1 3/2016 Il et al.
2016/0322728 A1 * 11/2016 Endo ..... H01R 13/187
2016/0344115 A1 11/2016 Miyakawa et al.
2017/0040728 A1 2/2017 Saito et al.

(56) References Cited

U.S. PATENT DOCUMENTS

| | | | | |
|---|---|---|---|---|
| 2017/0047677 | A1* | 2/2017 | Bhagyanathan Sathianathan ..... | H01R 13/18 |
| 2018/0076577 | A1* | 3/2018 | Ishida ..... | H01R 13/506 |
| 2018/0183165 | A1* | 6/2018 | Balser ..... | H01R 13/434 |

FOREIGN PATENT DOCUMENTS

| | | | | |
|---|---|---|---|---|
| CN | 106463867 | A | 2/2017 | |
| EP | 1291979 | A1 | 3/2003 | |
| EP | 2375512 | B1 * | 10/2015 | ..... H01R 13/4223 |
| JP | H1040989 | A | 2/1998 | |
| JP | H1040996 | A | 2/1998 | |
| JP | H10189119 | A | 7/1998 | |
| JP | 2007123265 | A | 5/2007 | |
| JP | 2013008645 | A | 1/2013 | |
| JP | 2013016359 | A | 1/2013 | |
| JP | 2013045566 | A | 3/2013 | |
| JP | 2013222707 | A | 10/2013 | |
| JP | 2015-125892 | A | 7/2015 | |
| WO | 2015/099179 | A1 | 7/2015 | |
| WO | 2015164754 | A1 | 10/2015 | |
| WO | 2017/015285 | A1 | 1/2017 | |
| WO | 2018/160814 | A1 | 9/2018 | |

OTHER PUBLICATIONS

Non-Final rejection received for U.S. Appl. No. 29/638,983, dated May 15, 2020, 7 pages.

Notice of Allowance received for U.S. Appl. No. 29/638,981, dated Dec. 10, 2018, 6 pages.

International Search Report and Written Opinion received for PCT application No. PCT/US2018/020416, dated Jun. 14, 2018, 9 pages.

* cited by examiner

ELECTRICAL TERMINAL AND CONNECTOR ASSEMBLY

RELATED APPLICATIONS

This application claims priority to PCT Application No. PCT/US2018/020416, filed on Mar. 1, 2018 which further claims priority to U.S. Provisional Application No. 62/465,355, filed on Mar. 1, 2017, each of which are incorporated herein by reference in their entirety.

TECHNICAL FIELD

This disclosure relates to the field of electrical terminals and connector assemblies into which the electrical terminals are mounted. More particularly, the present disclosure relates to an electrical terminal and, more specifically, to an electrical terminal for a connector system that can be used in a vehicle.

BACKGROUND ART

Electrical terminals used in connector systems for a vehicle are known. In general, connectors systems of this type are suitable for use in vehicle systems including junction distribution blocks, power control modules and other body control systems. These systems typically employ a wire harness to connect the various body and control systems throughout the vehicle.

Typical connector systems include a header or receptacle connector having a plurality of male electrical terminals or pins either mounted on a printed circuit board or retained in an insulative housing of the receptacle. A plug connector includes a molded exterior housing with a plurality of pockets or cavities to retain a plurality of female terminals for cooperatively mating with the receptacle connector housing. Each of the respective connector assemblies include an electrical terminal fitting that is removably engaged in the housing. Typically, the electrical fitting or housing has a deflectable locking arm that engages a window or shoulder formed on the terminal fitting or in the housing.

SUMMARY

In some embodiments, an electrical terminal includes a contact formed and a hood surrounding the contact. The contact and hood have cooperating retention features for securing the contact to the hood, and the hood provides strengthening features for improving the mechanical properties of the contact. The electrical terminal is mounted in a connector assembly. The electrical terminal has features which prevent or minimize damage to a seal of the connector assembly.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

DETAILED DESCRIPTION OF THE PREFERRED EMBODIMENTS

Figure 1:
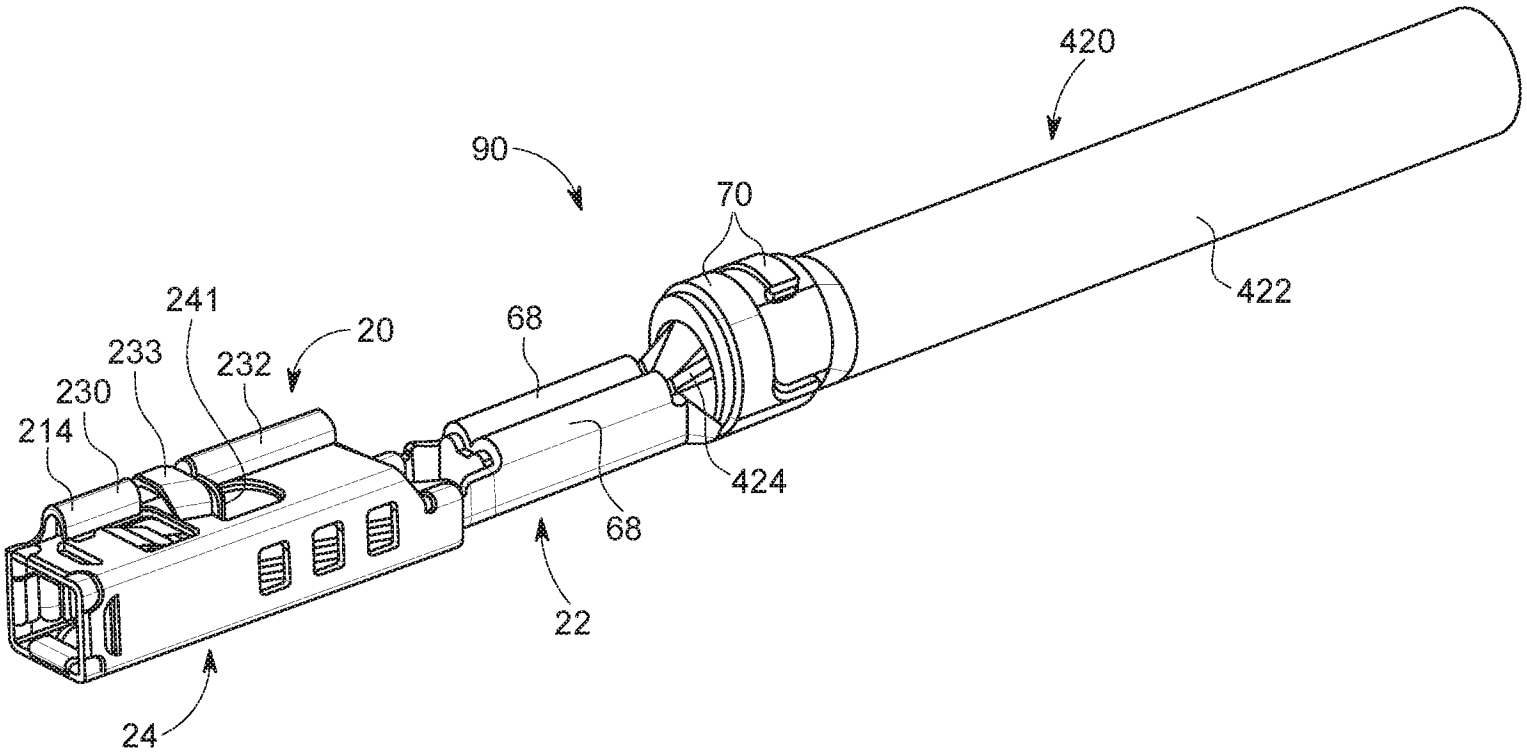
FIG. 1 is a front perspective view of a connector assembly and contact assembly coupled together.

The drawings illustrate an embodiment of the present disclosure and it is to be understood that the disclosed embodiment is merely exemplary of the disclosure, which may be embodied in various forms. Therefore, specific details disclosed herein are not to be interpreted as limiting, but merely as a basis for the claims and as a representative basis for teaching one skilled in the art to variously employ the present disclosure.

The present disclosure is directed to an electrical terminal 20 which mates with a connector assembly 620. The drawings illustrate a single circuit of the connector assembly 620 such that the illustrations for each element of the connector assembly 620 are a single slice or portion of the entire connector assembly 620; multiple circuits are provided to form the complete connector assembly 620. It should also be noted that directions such as "front", "rear", "top", "upper", "bottom" and "lower", etc. are used herein for convenience in description, do not denote a required orientation during use, are arbitrary, and are used to provide a clearer understanding of the embodiments shown.

The electrical terminal 20 is constructed from two separate pieces, a first piece or contact 22 and a second piece or hood 24. The two-part construction provides a smaller electrical terminal 20 while providing increased performance. The contact 22 is stamped and formed from a single piece of a highly conductive material, such as copper or any other copper based alloy or similar material having the same electrical conducting properties, allowing for superior electrical performance. The hood 24 is stamped and formed from a single piece of sheet metal formed of a high strength tensile material, such as stainless steel, to provide superior retention force and reinforcement. The tensile strength of the material forming the hood 24 is greater than the tensile strength of the material forming the contact 22. The electrical terminal 20 receives a corresponding male terminal 320, such as a pin or blade. Steel provides additional benefits to copper or copper based alloys. Steel typically exhibits higher tensile strength properties and situations where it is used in spring or biasing applications is a superior choice. The contact 22 and the hood 24 are formed separately, and are secured together via a separate assembly or marriage die.

In the embodiment, the following description is directed to the electrical terminal 20 having an electrical lead wire 420 attached thereto. The lead wire 420 has an insulative covering 422 over conductors 424 as is known in the art. The insulative covering 422 is partially removed at a leading end of the lead wire 420 to expose the conductors 424 provided therein.

The contact 22 is best shown in FIGS. 13-17. The contact 22 has a contact portion 26 which is configured to provide an electrical connection to the corresponding male terminal 320, a wire securing portion 28 which is configured to be coupled to the lead wire 420, and a transition portion 30 which connects the contact portion 26 to the wire securing portion 28.

The contact portion 26 is formed of a body 32 having opposite front and rear ends 32*a*, 32*b* and having a passageway 34 formed therethrough which extends from the front end 32*a* to the rear end 32*b*, and first and second cantilevered spring arms or contact beams 36, 38 extending from the body 32 and into the passageway 34. A centerline 40 is defined along the length of the body 32 from the front end 32*a* to the rear end 32*b*. The body 32 is formed of opposite top and bottom walls 42, 44 which are separated from each other by first and second upright side walls 46, 48 to form the passageway 34. Interior and exterior surfaces of each wall 42, 44, 46, 48 are planar. The top wall 42 has a front edge 42*a*, an opposite rear edge 42*b*, a first side edge 42*c* extending between the front and rear edges 42*a*, 42*b*, and a second side edge 42*d* extending between the front and rear edges 42*a*, 42*b*. Front edges 42*a*, 44*a*, 46*a*, 48*a* of the walls 42, 44, 46, 48 form an entrance opening 50 into the passageway 34.

A top opening 52 is formed in the top wall 42 proximate to, but spaced from, the front end 32*a* of the body 32 and is formed from a front edge 52*a*, a rear edge 52*b* and side edges 52*c*, 52*d* extending between the front and rear edges 52*a*, 52*b*. A bottom opening 54 is formed in the bottom wall 44 proximate to, but spaced from, the front end 32*a* of the body 32 and is formed from front, rear edge and side edges which vertically align with the edges 52*a*, 52*b*, 52*c*, 52*d* of the top opening 52.

The contact beam 36 extends rearwardly from the forward edge 52*a* of the top opening 52 rearwardly, through the top opening 52 and into the passageway 34. The contact beam 38 extends rearwardly from the forward edge 54*a* of the bottom opening 54, through the bottom opening 52 and into the passageway 34. The contact beams 36, 38 are configured to electrically engage the mating male terminal 320. In an embodiment, each contact beam 36, 38 has a front end connected to the respective forward edge of the opening 52, 54, a front section 56 which extends rearwardly from the forward edge of the opening 52, 54 and curves inwardly relative to the centerline 40, an intermediate section 58 which extends rearwardly from the front section 56 and is angled inwardly relative to the centerline 40 and relative to the front section 56, and a rear section 60 which extends rearwardly from the intermediate section 58 and curves inwardly and then outwardly relative to the centerline and relative to the intermediate section 58. The rear section 60 terminates in a free rear end 60*a*. Each contact beam 36, 38 has a length which is defined from the forward edge to the rear end 60*a*. In an embodiment, the lengths are the same. In an embodiment, the contact beams 36, 38 are vertically aligned with each other.

In an embodiment, a dimple 62 is provided on an interior surface of each side wall 46, 48 forwardly of the forward edges of the openings 52, 54. The dimples 62 may have a dome shape.

A plurality of spaced apart protrusions 64 extend outwardly from the exterior surface of the side walls 46, 48 and are rearward of the openings 52, 54. As shown, three protrusions 64 are provided, although more or fewer protrusions 64 may be provided. In an embodiment, each projection 64 has a rear face 64*a* which extends perpendicular to the centerline 40.

The rear edge 42*b* of the top wall 42 is longitudinally spaced from the rear end 32*b* of the body 32. An upper portion of each rear end 46*b*, 48*b* of the side walls 46, 48 extends at an angle downwardly and rearwardly from the rear edge 42*b* of the top wall 42 to the rear end 32*b* of the body 32.

A flange 65 extends upwardly from the side wall 46 and upwardly of the top wall 42 along the side edge 42*c* thereof. The flange 65 is parallel to, but offset from, the centerline 40. The flange 65 is rearward of the top opening 52 and spaced from the top opening 52. The flange 65 has a first, front surface 65*a* which is perpendicular to the top wall 42, a second surface 65*b* which extends rearwardly from a top end of the first surface 65*a* and at an angle relative to the first surface 65*a*, a third, top surface 65*c* which extends rearwardly from a rear end of the second surface 65*b* and is generally parallel to the top wall 42, and a fourth, rear surface 65*d* which extends downwardly from a rear end of the third surface 54*c* and which is perpendicular to the top wall 42.

The wire securing portion 28, in an embodiment, is generally U-shaped. The wire securing portion 28 is configured to receive the electrical lead wire 420. The wire securing portion 28 includes a curved base wall 66 having front and rear ends 66*a*, 66*b*, wire crimp portions 68 extending upwardly from the base wall 66 and configured to connect to the exposed conductors 424 of the lead wire 420, and insulation crimp portions 70 extending upwardly from the base wall 66 and configured to connect to the insulative covering 422 of the lead wire 420. The base wall 66 is sized to accommodate the exposed conductors 424 and the insulative covering 422 of the electrical lead wire 420. The wire crimp portions 68 are forward of the insulation crimp portions 70. In an embodiment, the wire crimp portions 68 are formed as wings extending upwardly from the base wall 66, and the insulation crimp portions 70 are formed as wings extending upwardly from the base wall 66.

To connect the lead wire 420 to the wire securing portion 28, a front portion of the insulative covering 422 is removed to expose the conductors 424. The bare conductors 424 are placed within the base wall 66 below the wire crimp portions 68 and a portion of the lead wire 420 having the intact insulative covering 422 is placed within the base wall 66 below the insulation crimp portions 70. The portions 68, 70 are then folded over the respective portions of the lead wire 420 to secure the lead wire 420 to the contact 22, with the wire crimp portions 68 securing or crimping the contact 22 to the bare conductors 424 and the insulation crimp portions 70 securing or crimping the insulative covering 422 to the contact 22.

The transition portion 30 of the electrical terminal 20 extends between the contact portion 26 and the wire securing portion 28. The transition portion 30 has a generally U-shaped base wall 72 having side walls 74, 76 extending upwardly therefrom. A front portion of each side wall 74, 76 extends longitudinally and a rear portion 80 of each side wall 74, 76 extends at an angle inwardly toward the centerline 40 from the front portion to the wire securing portion 28. A top edge of each front portion forms a notch 82 having a front surface 84 extending downwardly from the bottom end of the respective rear edge 46*b*, 48*b*, a planar intermediate surface 86 which extends longitudinally, and a rear surface 88 extending upwardly from the rear end of the respective intermediate surface 86.

When the electrical terminal 20 and the lead wire 420 are connected together, a contact assembly 90 is formed.

The hood 24 is best shown in 18-25. The hood 24 is formed of a body 132 having opposite front and rear ends 132*a*, 132*b* and having a passageway 134 formed therethrough which extends from the front end 132*a* to the rear end 132*b*, and first and second cantilevered stiffening beams 136, 138 extending from the body 132 and into the passageway 134. A centerline 140 is defined along the length of the body 132 from the front end 132*a* to the rear end 132*b*. The body 132 is formed of opposite top and bottom walls 142, 144 which are separated from each other by first and second upright side walls 146, 148 to form the passageway 134. Interior and exterior surfaces of each wall 142, 144, 146, 148 are planar. The top wall 142 has a front edge 142*a*, an opposite rear edge 142*b*, and side edges 142*c*, 142*d* extending between the front and rear edges 142*a*, 142*b*.

A front opening 152 is formed in the top wall 142 and is formed from a front edge 152*a*, a rear edge 152*b* and side edges 152*c*, 152*d* extending between the front and rear edges 152*a*, 152*b*. The front opening 152 is spaced from the front edge 142*a* and from the side edges 142*c*, 142*d*. A front window 153 is formed in the top wall 142 and is forward of the front opening 152. The front window 153 is proximate to, but spaced from, the side edge 142*c*. A rear window 155 is formed in the top wall 142 and is rearward of the front opening 152 and is spaced from the side edges 142*c*, 142*d*. The rear window 155 is formed from a front edge 155*a*, a rear edge 155*b* and side edges 155*c*, 155*d* extending between the front and rear edges 155*a*, 155*b*. A rear window 157 is formed in the top wall 142 and is rearward of the rear opening 155, but may be partially aligned with the rear opening 155 in the longitudinal direction. The rear window 157 extends from the side edge 142*c*. A bottom opening 154 is formed in the bottom wall 144 proximate to, but spaced from, the front end 132*a* of the body 132 and is formed from front, rear edge and side edges which vertically align with the edges 152*a*, 52*b*, 152*c*, 152*d* of the front opening 152. A bottom opening 154 is formed in the bottom wall 144 proximate to, but spaced from, the front end 132*a* of the body 132 and is formed from front, rear edge and side edges which vertically align with the edges 152*a*, 52*b*, 152*c*, 152*d* of the front opening 152.

The stiffening beam 136 extends rearwardly from the forward edge 152*a* of the front opening 152, through the front opening 152 and into the passageway 134. The stiffening beam 138 extends rearwardly from the forward edge of the bottom opening 154, through the bottom front opening 152 and into the passageway 134. The stiffening beams 136, 138 are configured to engage the contact beams 36, 38 of the contact 22 to provide reinforcement of the contact beams 36, 38. In an embodiment, each stiffening beam 136, 138 has a front end connected to the respective forward edge of the openings 152, 154 and a section 192 which extends rearwardly from the forward edge 152*a*, 154*a* and is angled inwardly relative to the centerline 140. The section 192 terminates in a free rear end 192*a*. Each stiffening beam 136, 138 has a length which is defined from the forward edge to the rear end 192*a*. In an embodiment, the lengths are the same. In an embodiment, the stiffening beams 136, 138 are vertically aligned with each other. The length of each stiffening beam 136, 138 is less than the length of the respective contact beam 36, 38. In an embodiment, each stiffening beam 136, 138 has a length which is less than the combined lengths of the front and intermediate sections 56, 58 of the contact beams 36, 38. In an embodiment, each stiffening beam 136, 138 has a length which is substantially equal to the combined lengths of the front and intermediate sections 56, 58 of the contact beams 36, 38.

Figure 2:
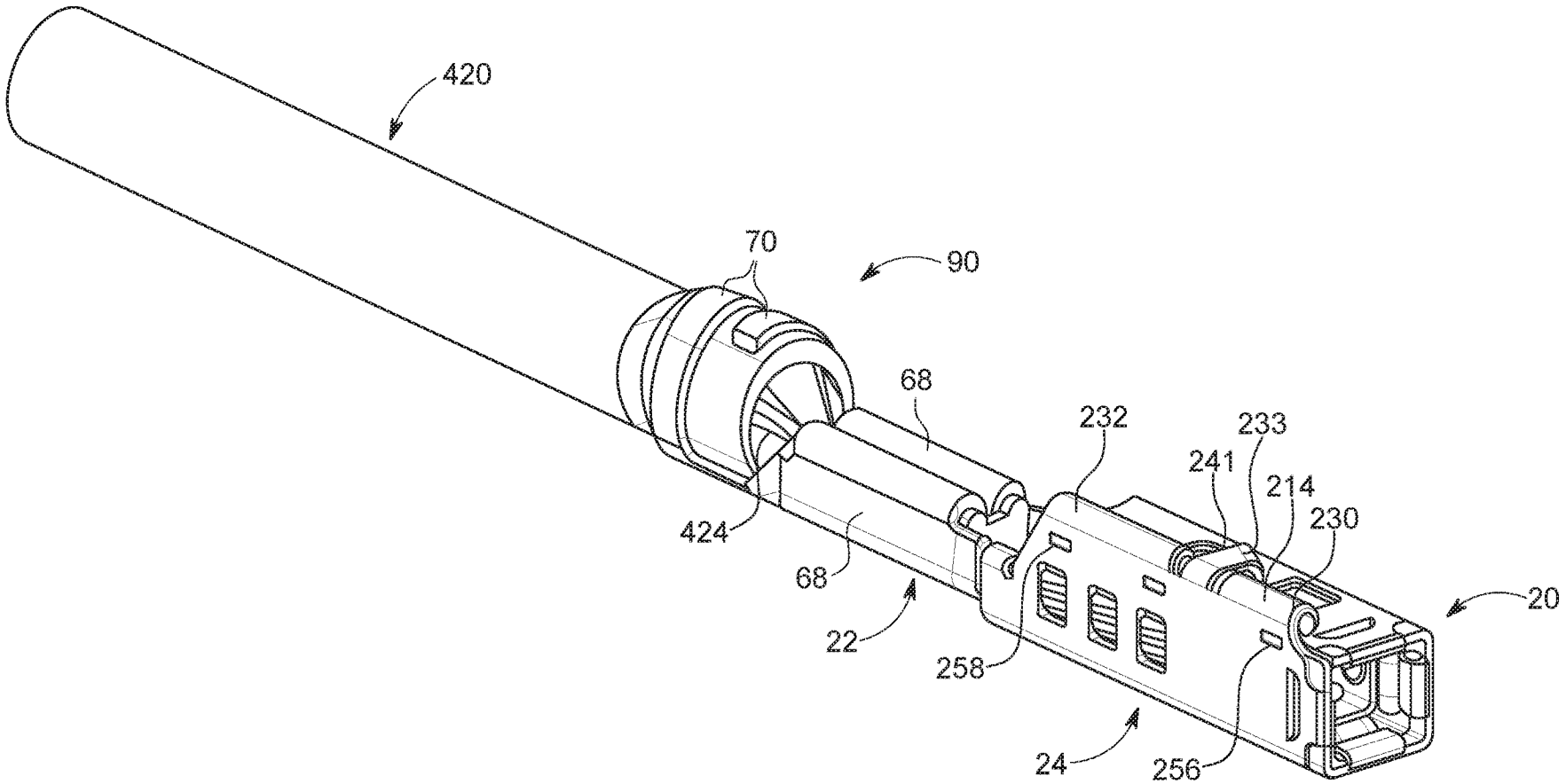
FIG. 2 is a rear perspective view of the connector assembly and contact assembly coupled together.
Figure 3:
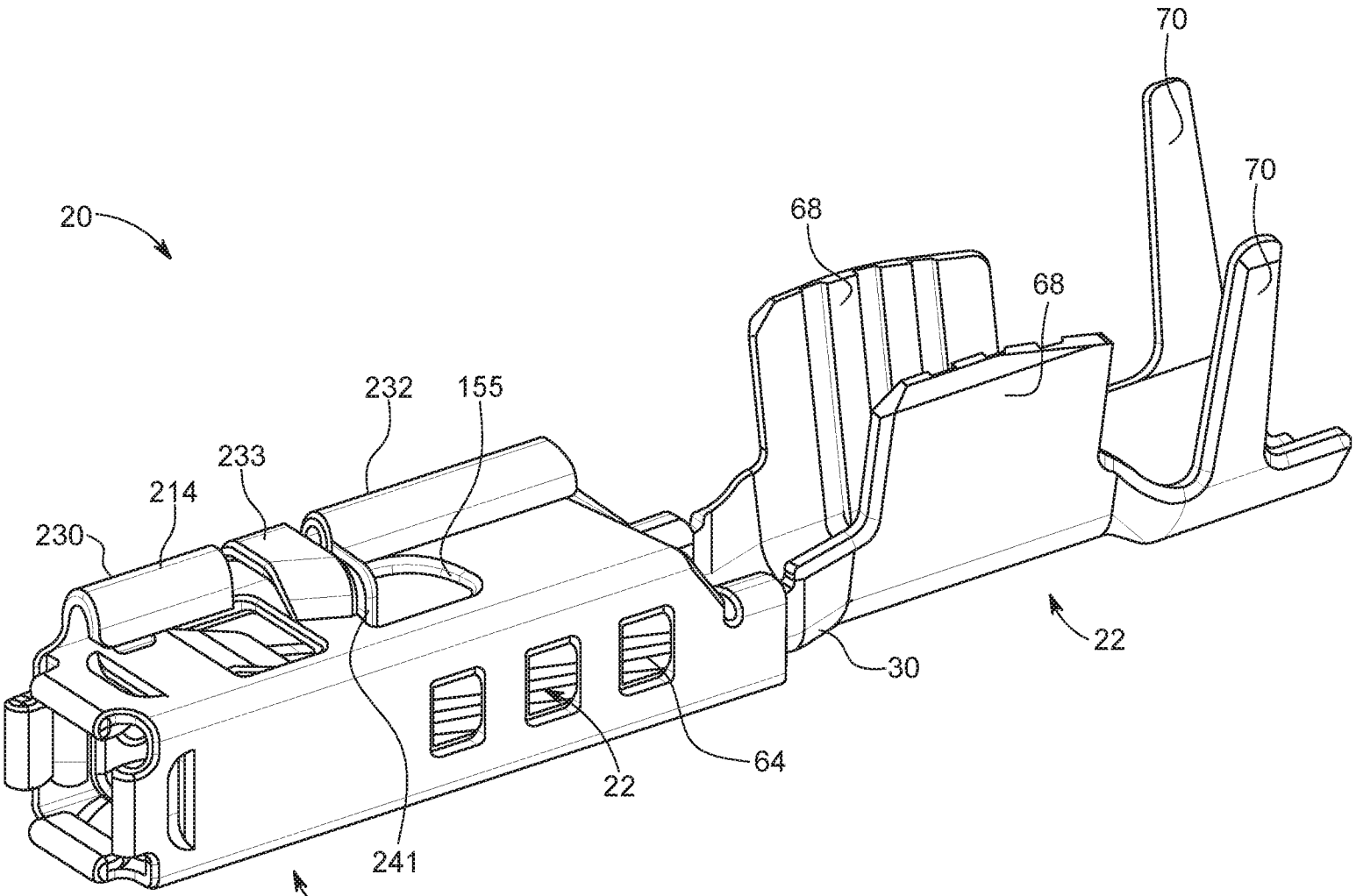
FIG. 3 is a front perspective view of a contact of the contact assembly and a hood of the contact assembly coupled together which form an electrical terminal.
Figure 4:
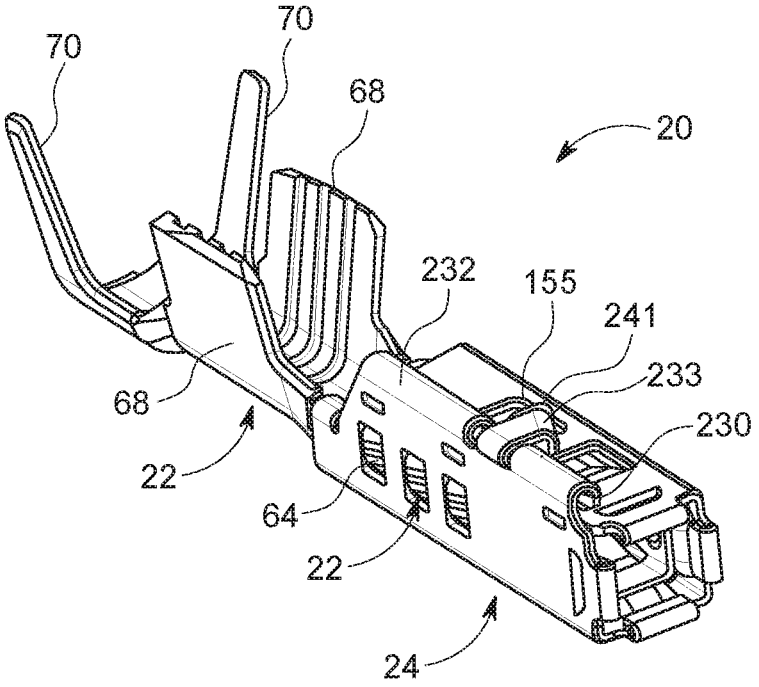
FIG. 4 is an alternate front perspective view of the electrical terminal.
Figure 5:
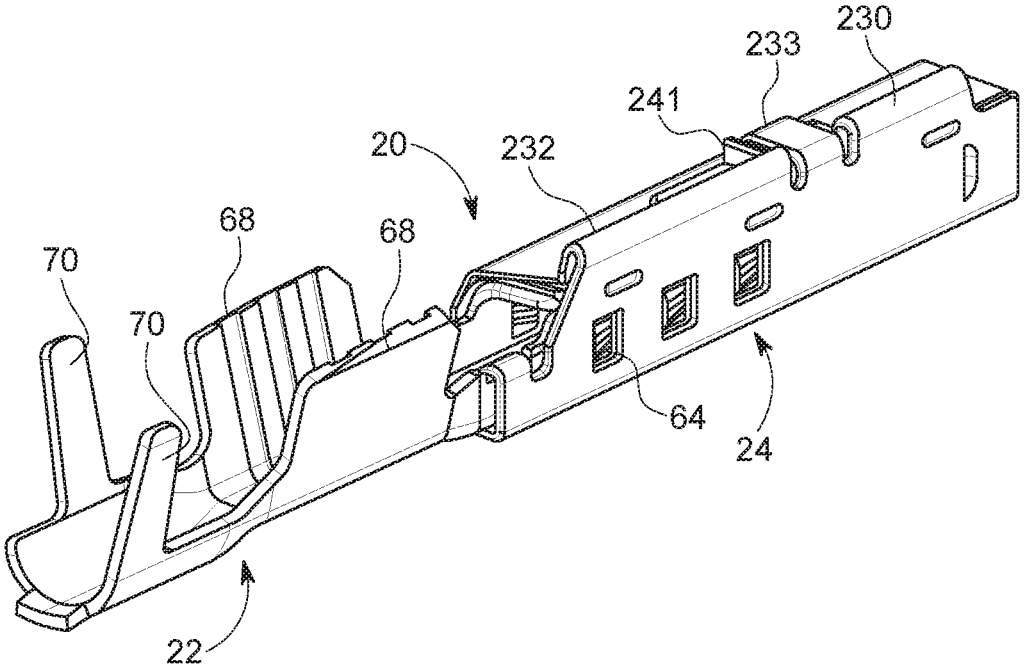
FIG. 5 is a rear perspective view of the electrical terminal.
Figure 6:
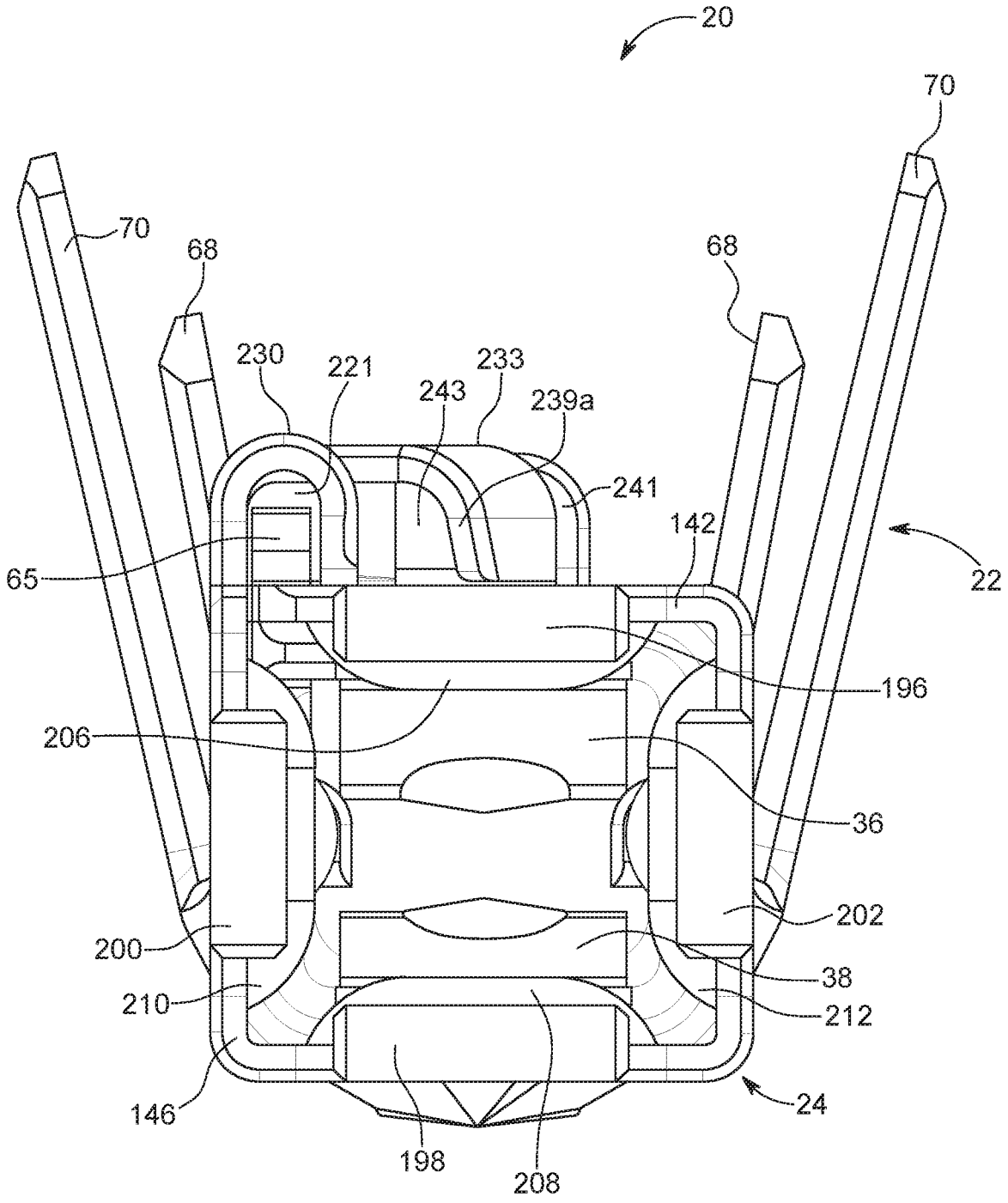
FIG. 6 is a front elevation view of the electrical terminal.
Figure 7:
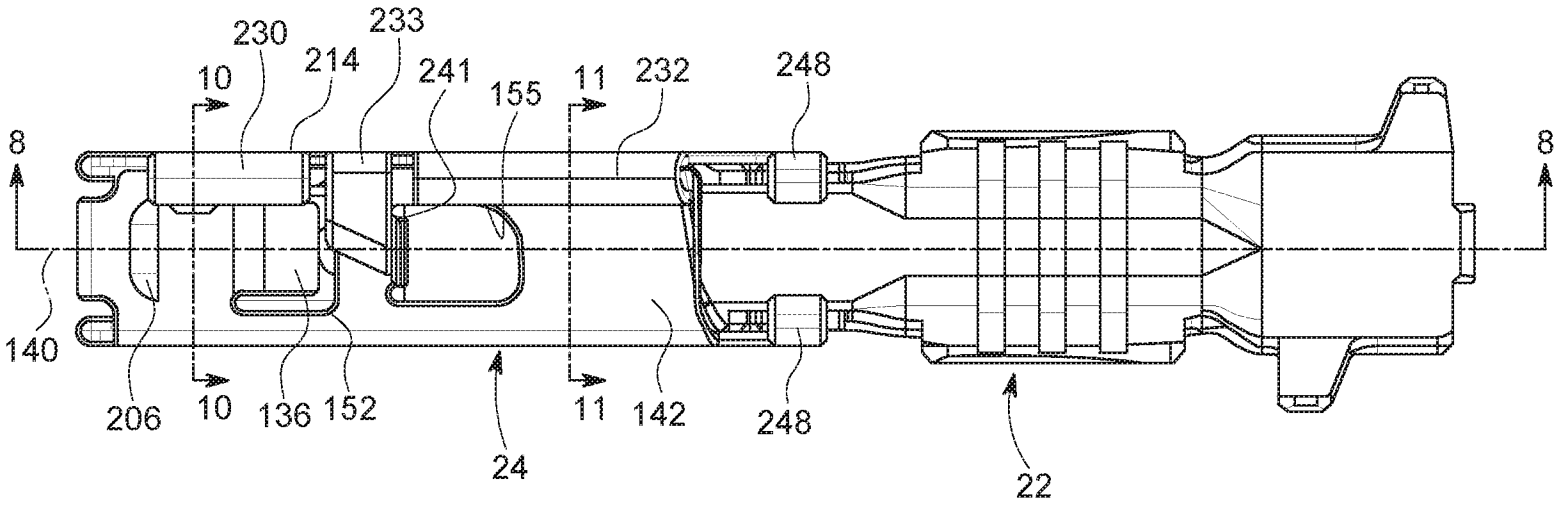
FIG. 7 is a top plan view of the electrical terminal.
Figure 8:
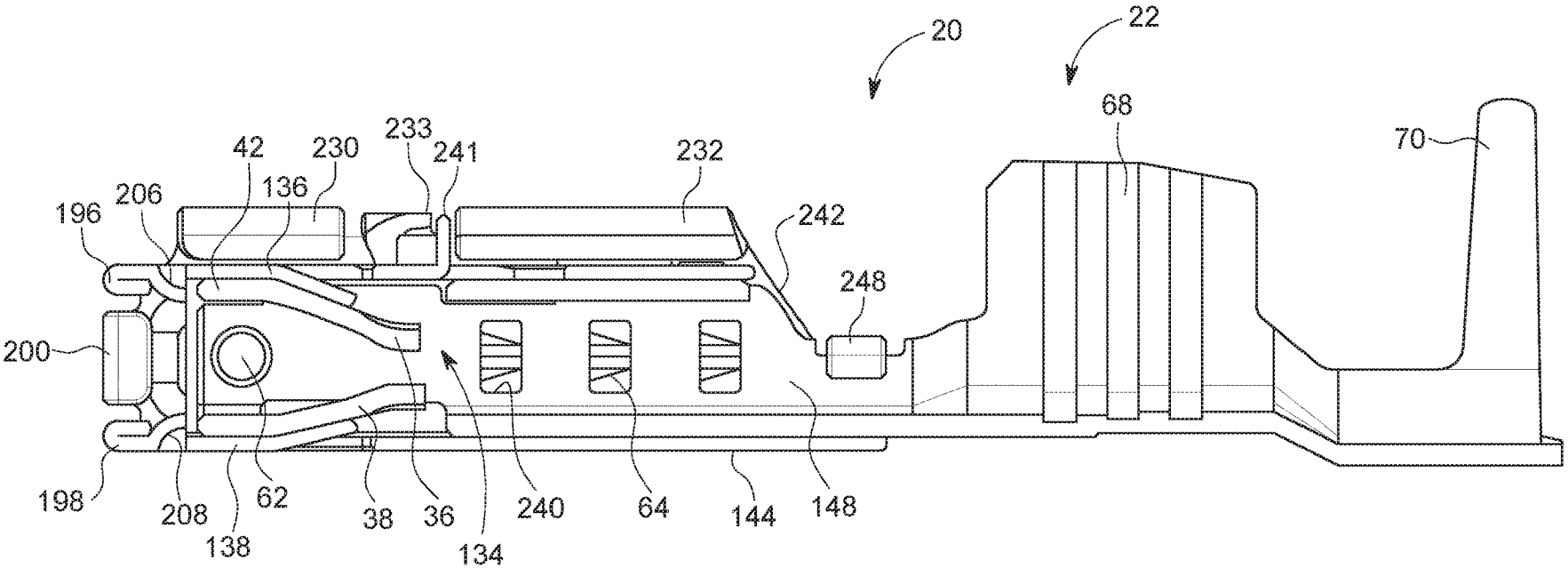
FIG. 8 is a cross-sectional view of the electrical terminal along line 8-8 of FIG. 7.
Figure 9:
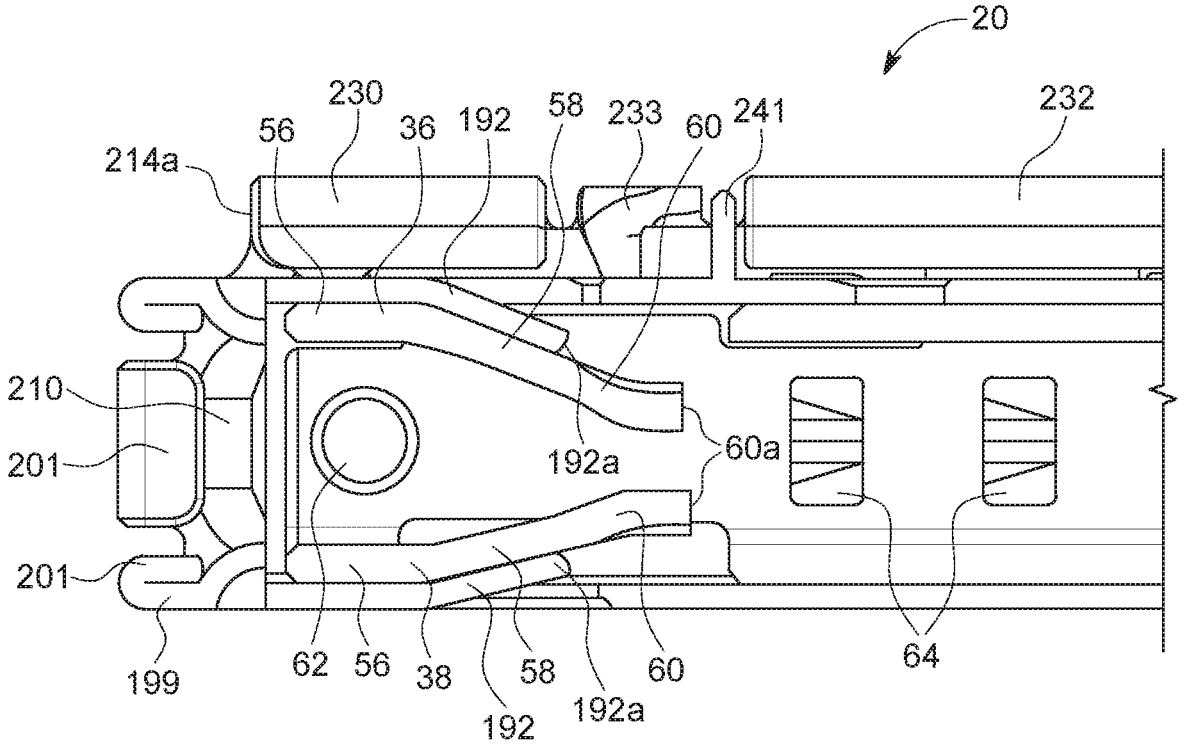
FIG. 9 is a cross-sectional view of a portion of the electrical terminal.
Figure 10:
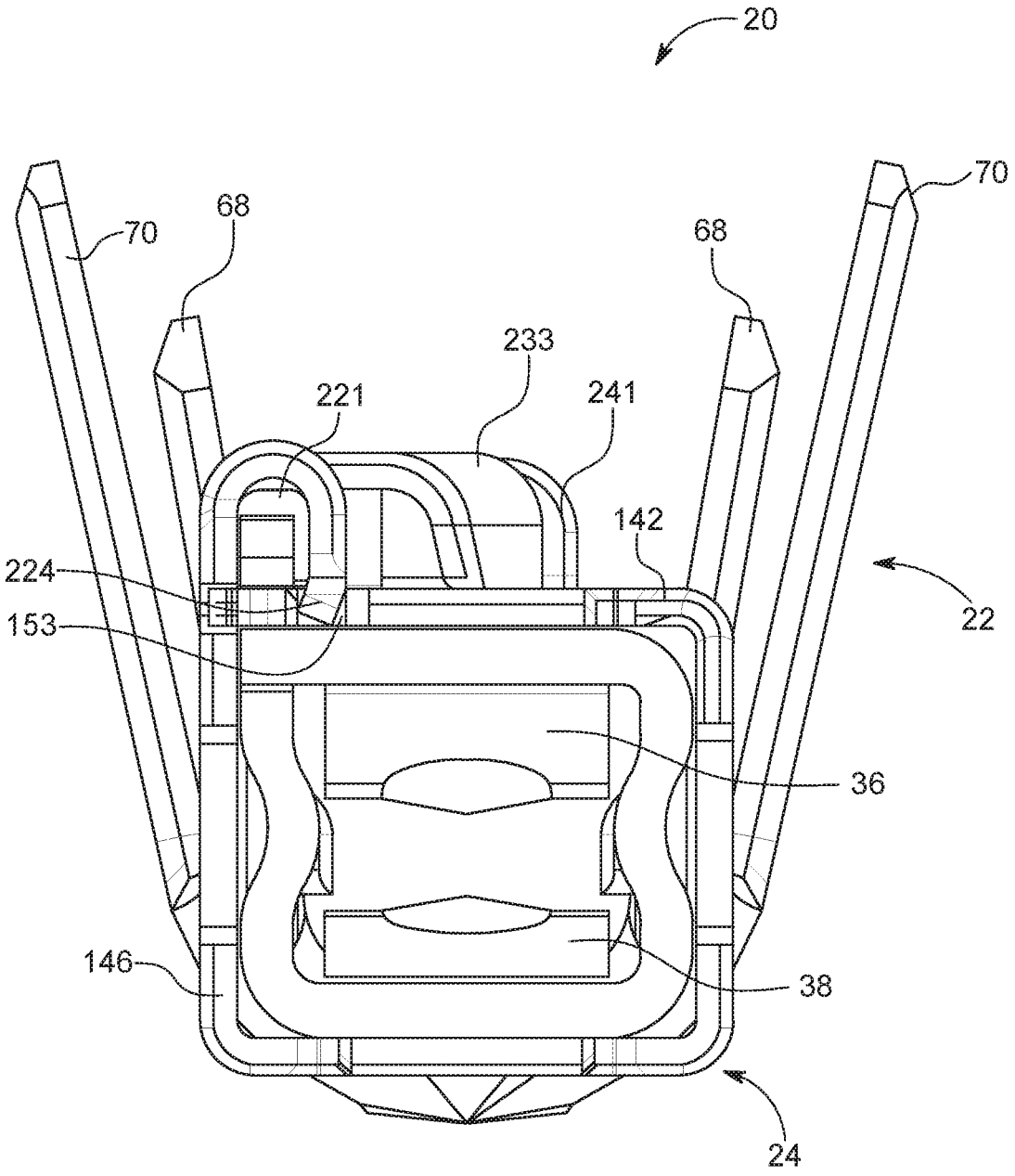
FIG. 10 is a cross-sectional view of the electrical terminal along line 10-10 of FIG. 7.
Figure 11:
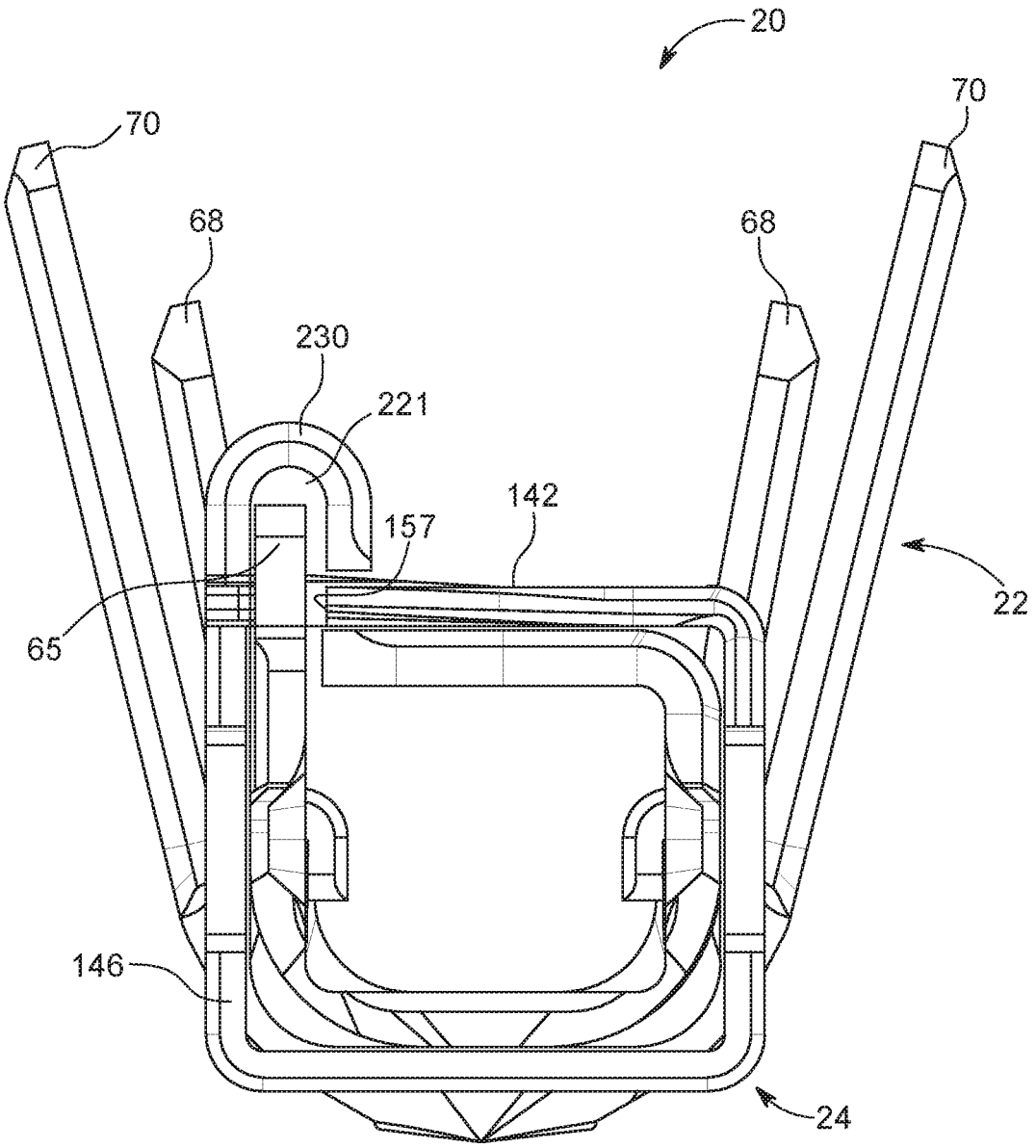
FIG. 11 is a cross-sectional view of the electrical terminal along line 11-11 of FIG. 7.
Figure 12:
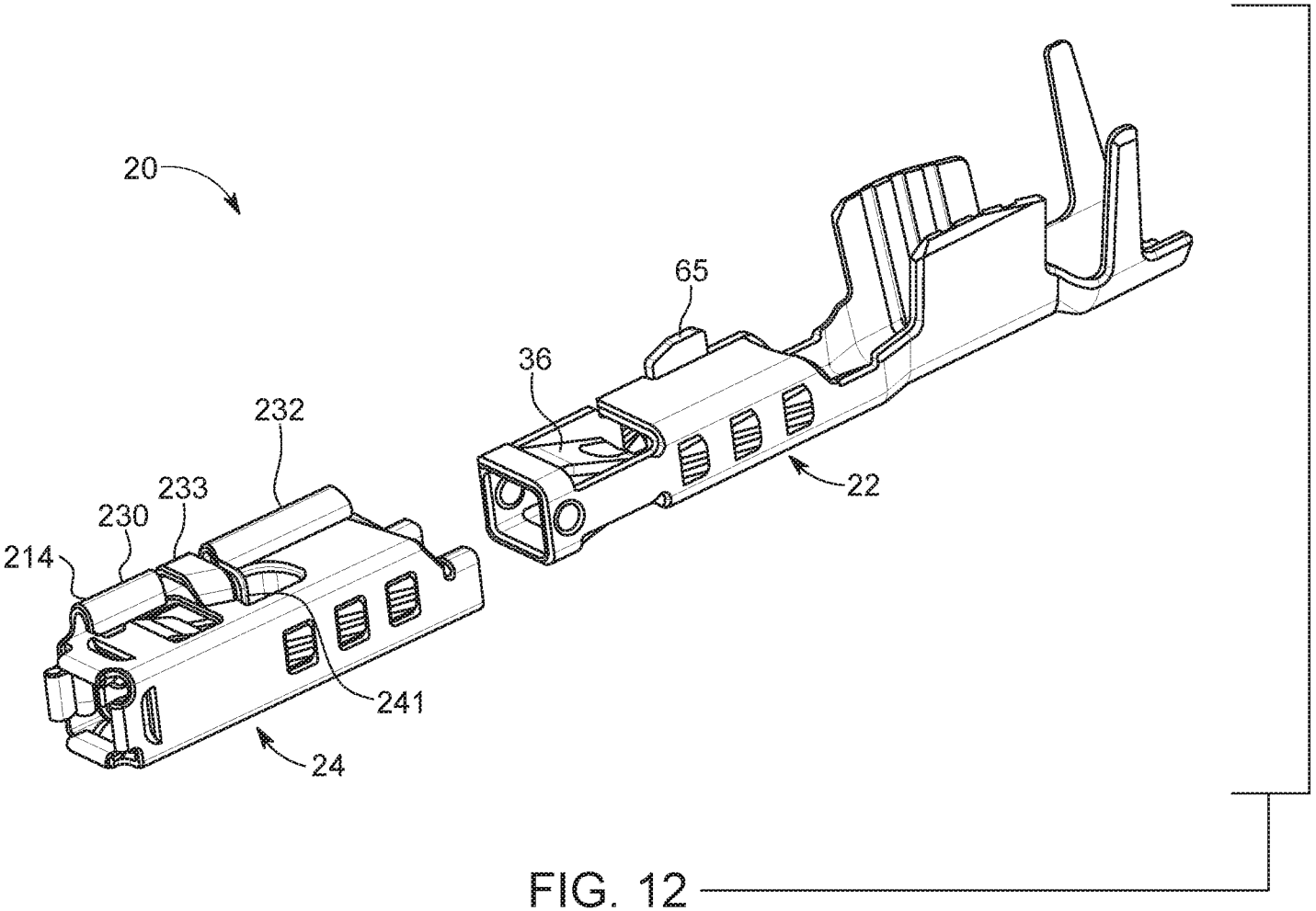
FIG. 12 is a front perspective view of the contact and the hood exploded apart.
Figure 13:
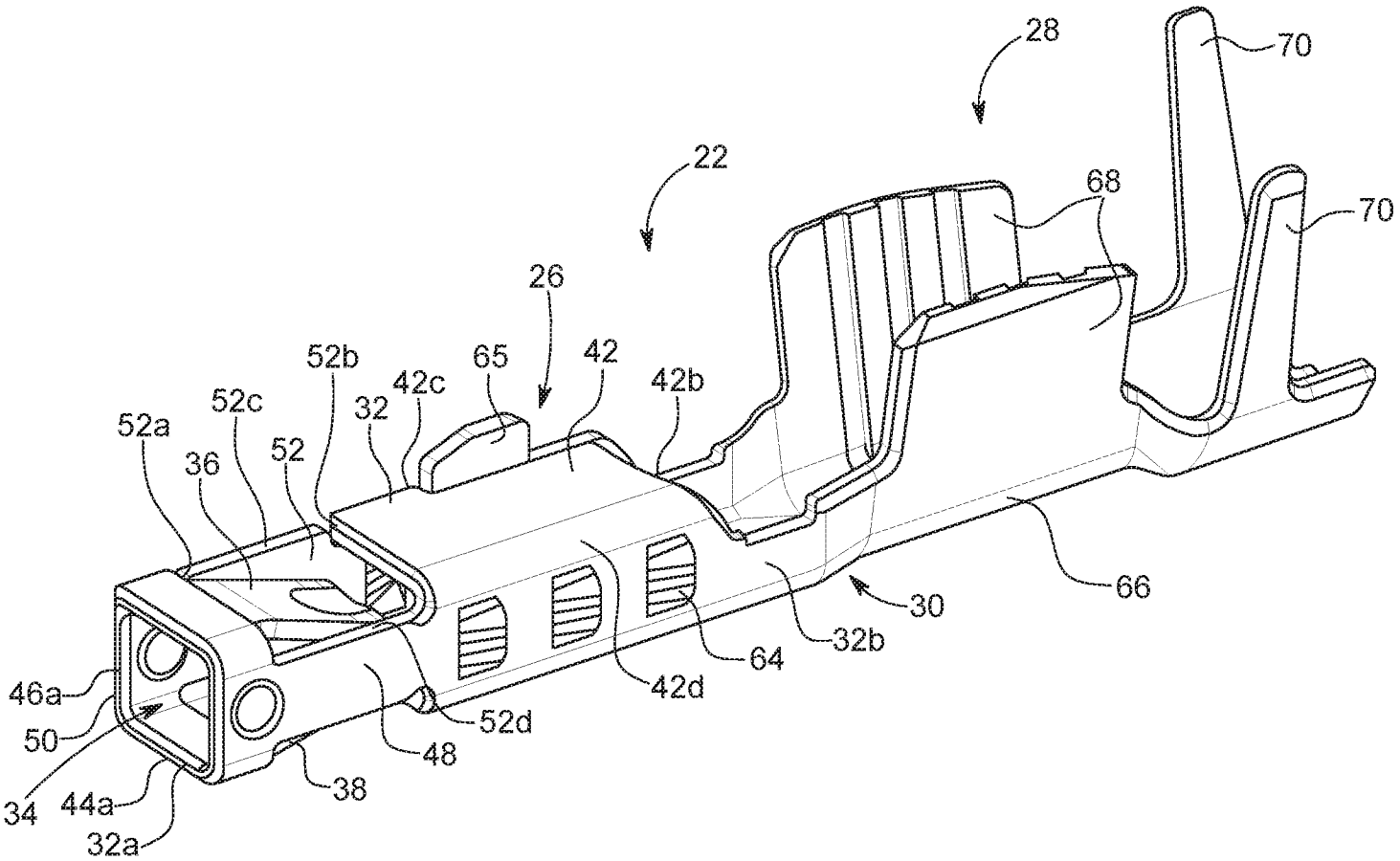
FIG. 13 is a front perspective view of the contact.
Figure 14:
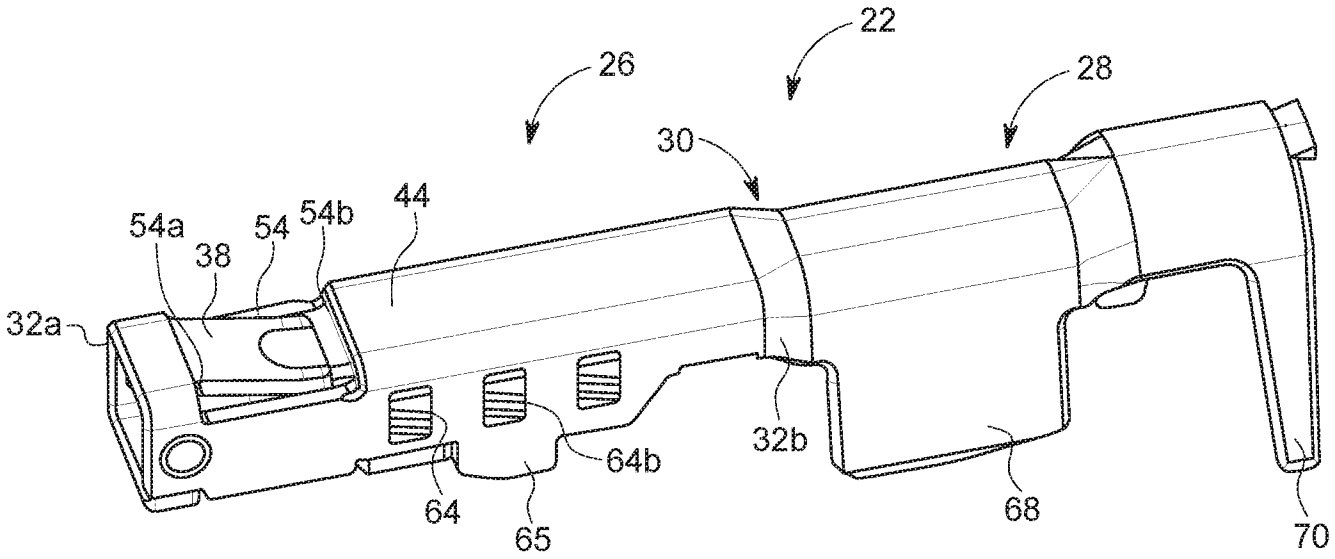
FIG. 14 is an alternate front perspective view of the contact.
Figure 15:
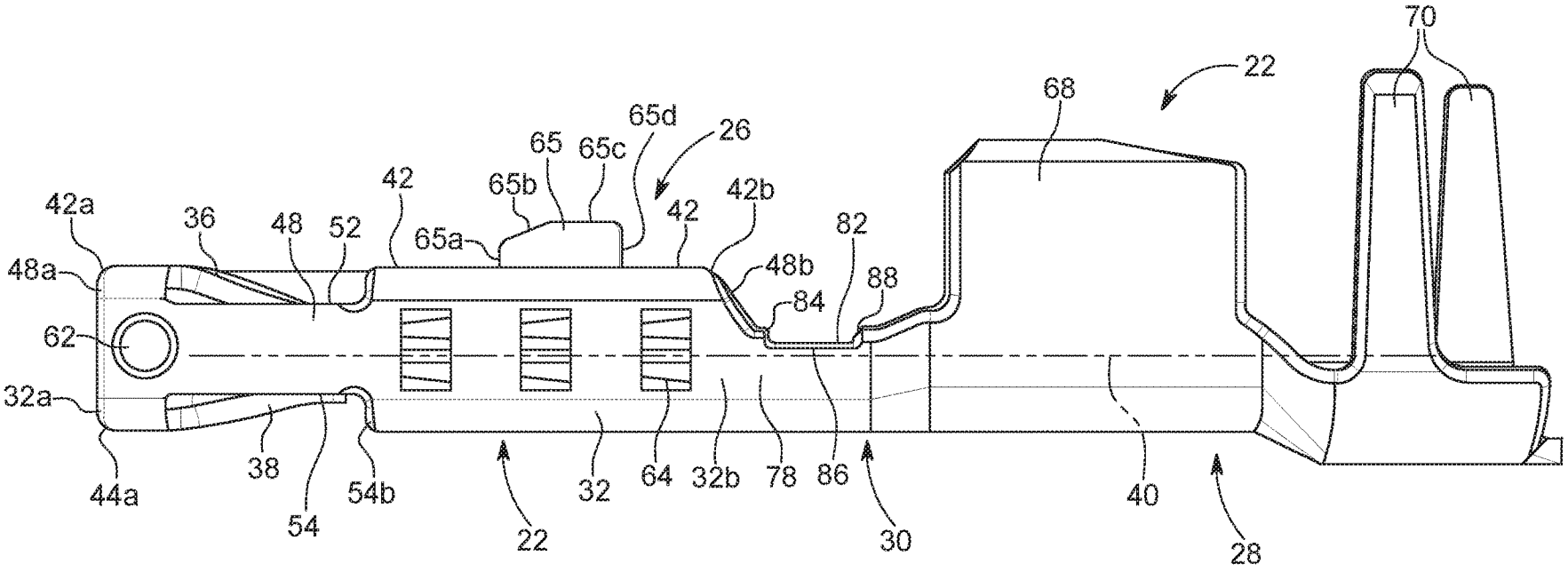
FIG. 15 is a side elevation view of the contact.
Figure 16:
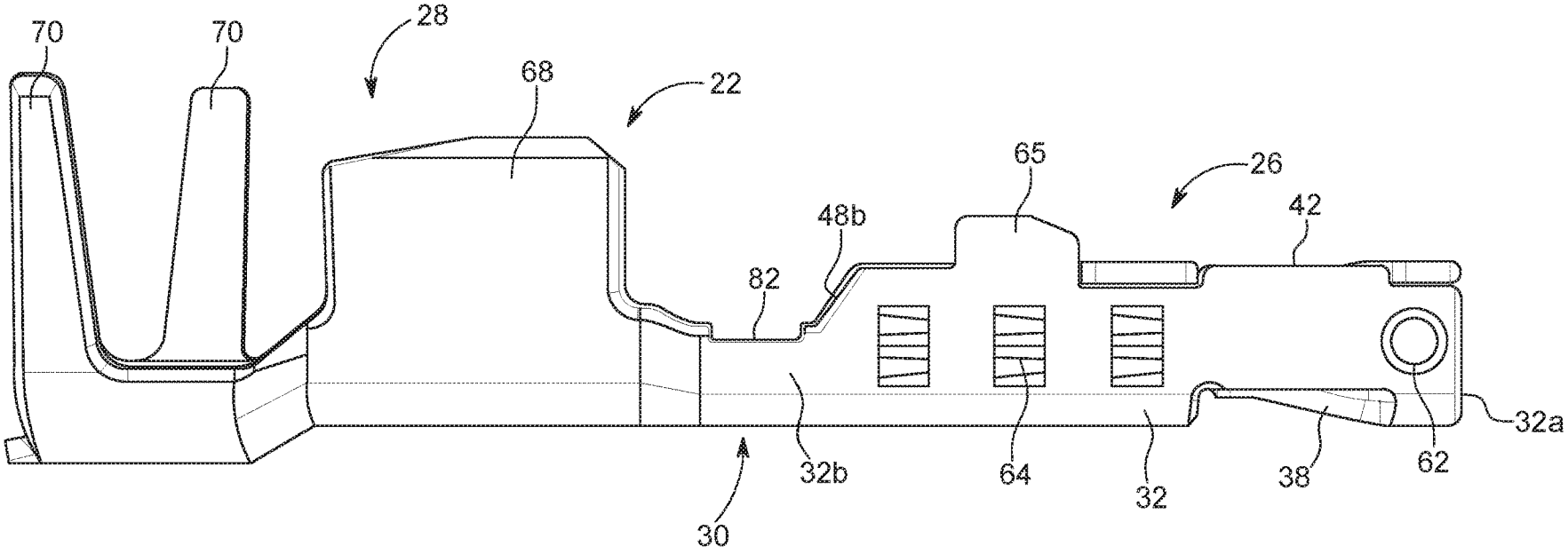
FIG. 16 is an alternate side elevation view of the contact.
Figure 17:
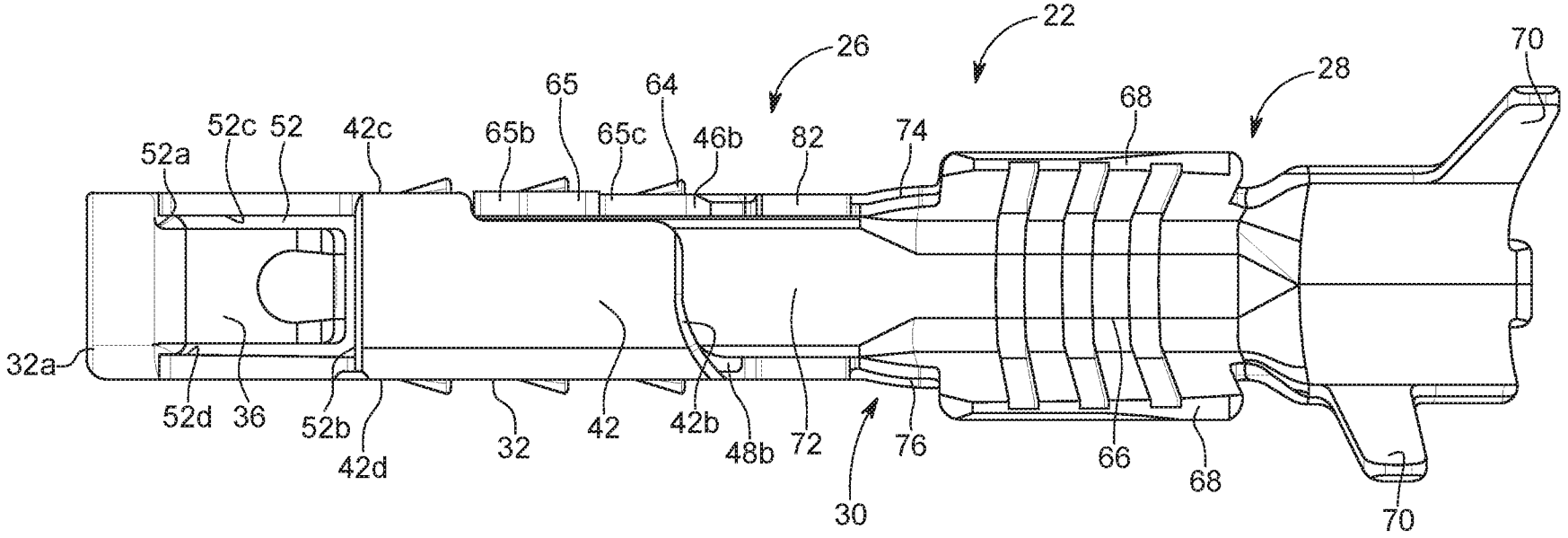
FIG. 17 is a top plan view of the contact.
Figure 18:
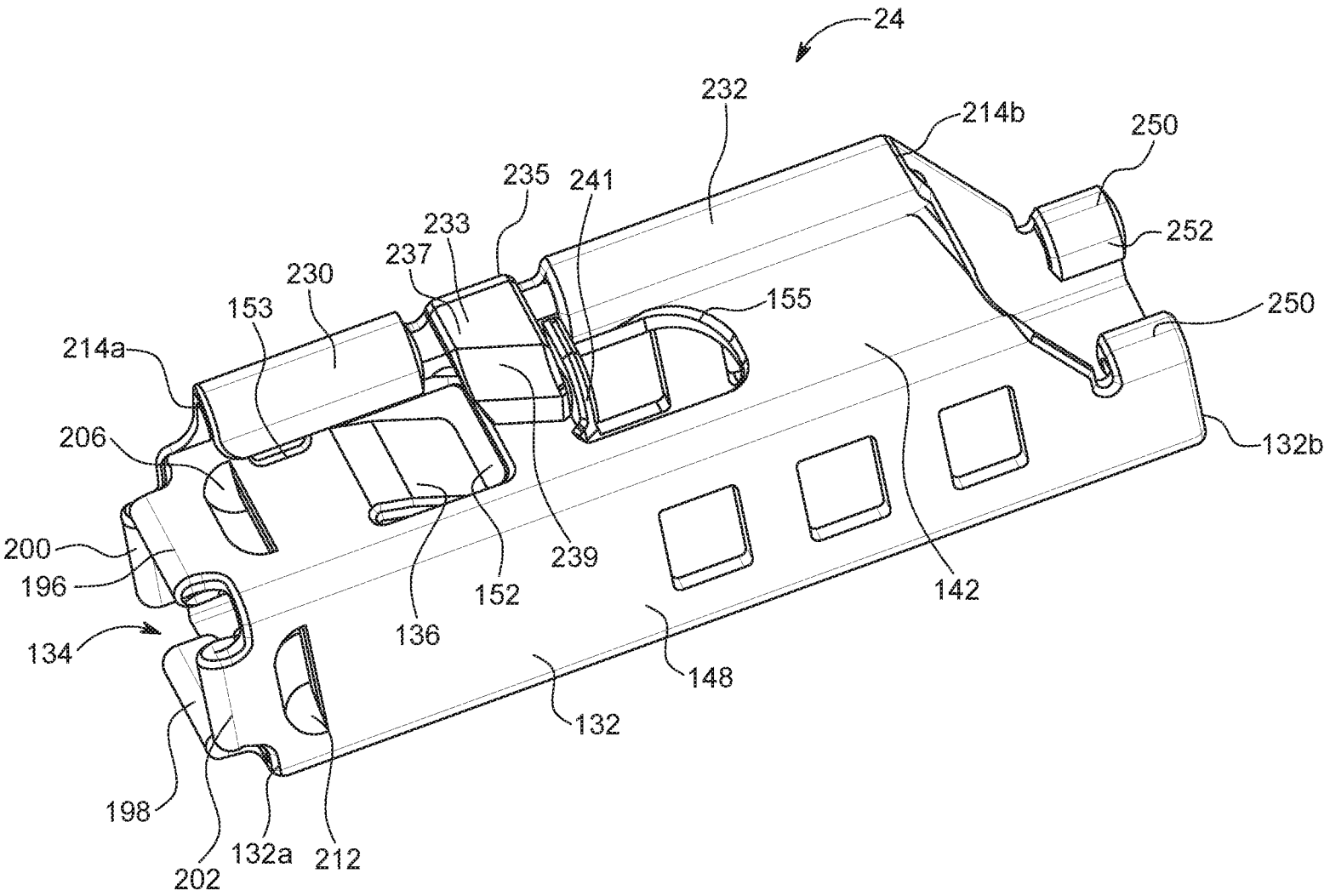
FIG. 18 is a front perspective view of the hood.
Figure 19:
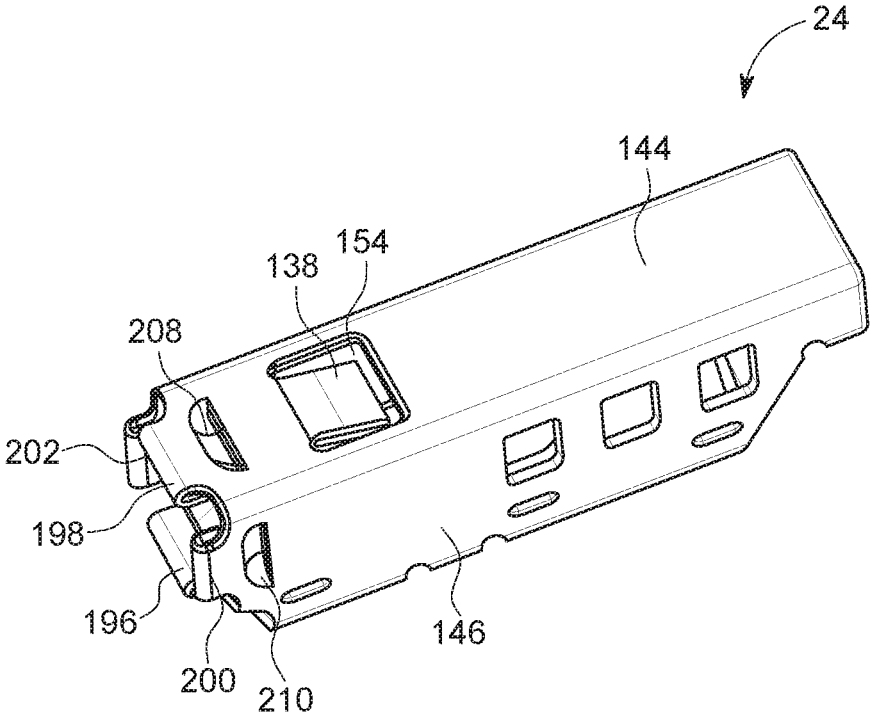
FIG. 19 is an alternate front perspective view of the hood.

In an embodiment, a flange 196, 198, 200, 202 extends from the respective wall 142, 144, 146, 148 at the front end 132*a* of the body 132 and defines an entrance opening 204 into the passageway 134 (these flange 196, 198, 200, 202 are not shown in FIGS. 1, 2 and 5). In an embodiment, flanges 196, 198 have widths which are less than the widths of the top and bottom walls 142, 144, and the flanges 200, 202 have heights which less than the heights of the first and second side walls 146, 148, and each flange 196, 198, 200, 202 is formed of two wall portions 199, 201. Wall portion 199 extends outwardly the respective wall 142, 144, 146, 148, is planar therewith and parallel to the centerline 140, and wall portion 201 is bent inwardly toward the centerline 140 and then bent rearwardly. In an embodiment, each wall portion 201 is angled at an angle of about 120 degrees to about 180 degrees relative to a centerline of the first wall portion 199.

A projection 206, 208, 210, 212 extends inwardly from the respective wall 142, 144, 146, 148 proximate to the front end 132*a* of the body 132 and into the passageway 134. The projections 206, 208, 210, 212 act as forward stops when the contact 22 is inserted into the hood 24 as described herein. In an embodiment, each projection 206, 208, 210, 212 has a rear face which extends perpendicular to the centerline 140.

An alignment rib 214 extends upwardly from the top wall 142 and overlaps a portion of the top wall 142. In an embodiment, the alignment rib 214 overlaps a portion of the front opening 152 and the stiffening beam 136. The alignment rib 214 has front and rear ends 214*a*, 214*b* and a planar top surface 216. In an embodiment, the rear end 214*b* angles downwardly relative to the centerline 140 of the body 132 and outwardly away from the front end 132*a* of the body 132.

The alignment rib 214 includes front and rear sections 230, 232 which are spaced apart from each other by an intermediate section 233. The front section 230 has a front end 230*a* which is proximate to, but spaced from, the front end 132*a* of the body 132 such that a space 238 is provided forward of the alignment rib 214, and a rear end 230*b* which is proximate to, but spaced from a front end 233*a* of the intermediate section 233. In an embodiment, the front end 230*a* is perpendicular to the centerline 140 of the body 132. The rear section 232 has a front end 232*a* which is proximate to, but spaced from, a rear end 233*b* of the intermediate section 233, and a rear end 232*b* which is proximate to, but spaced from, the rear end 132*b* of the body 132. In an embodiment, the front end 232*a* is perpendicular to the centerline 140 of the body 132. In an embodiment, the rear end 232*a* of the rear section 232 angles downwardly relative to the centerline 140 of the body 132 and outwardly away from the front end 132*a* of the body 132.

Figure 23:
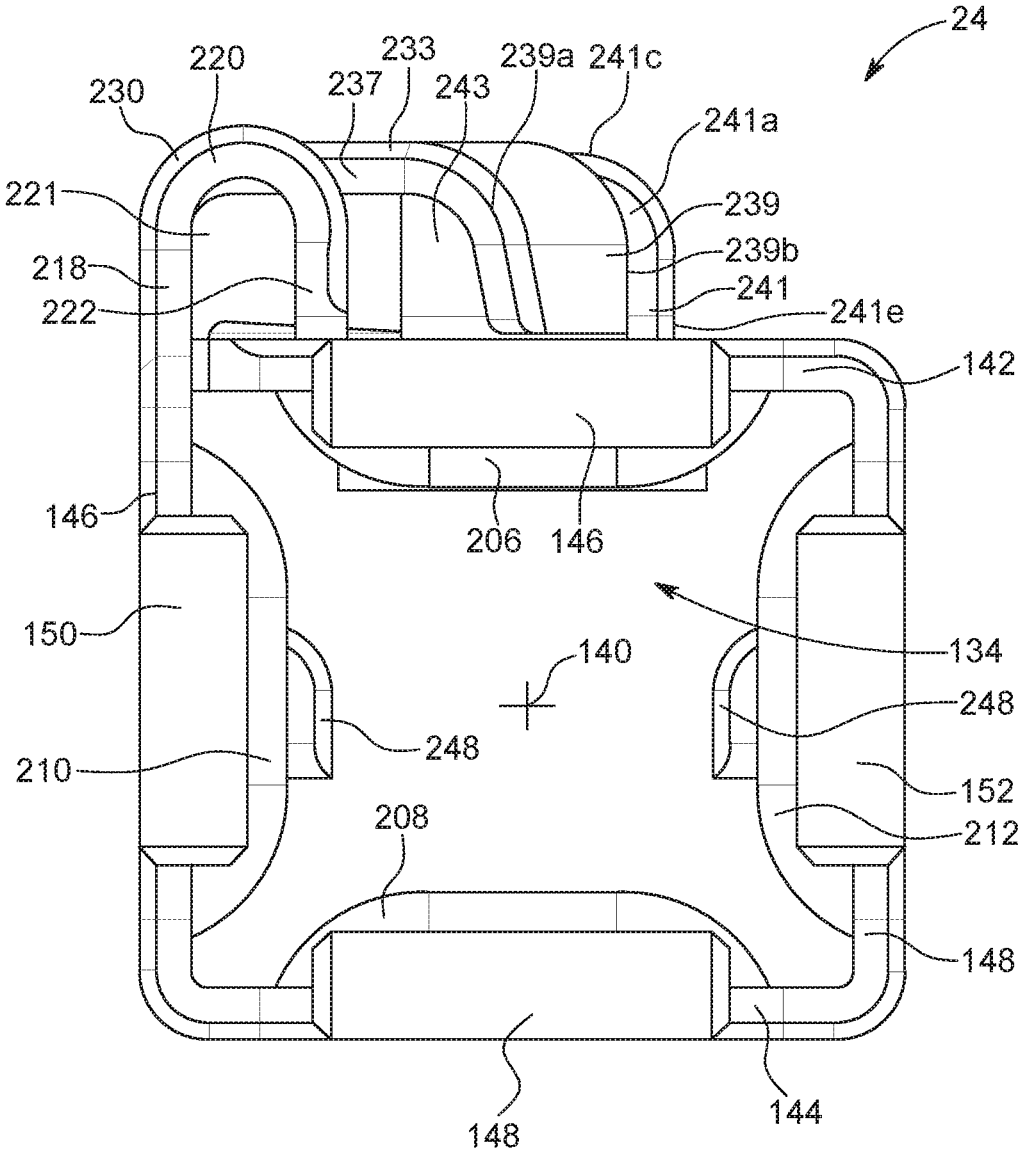
FIG. 23 is a front elevation view of the hood.
Figure 24:
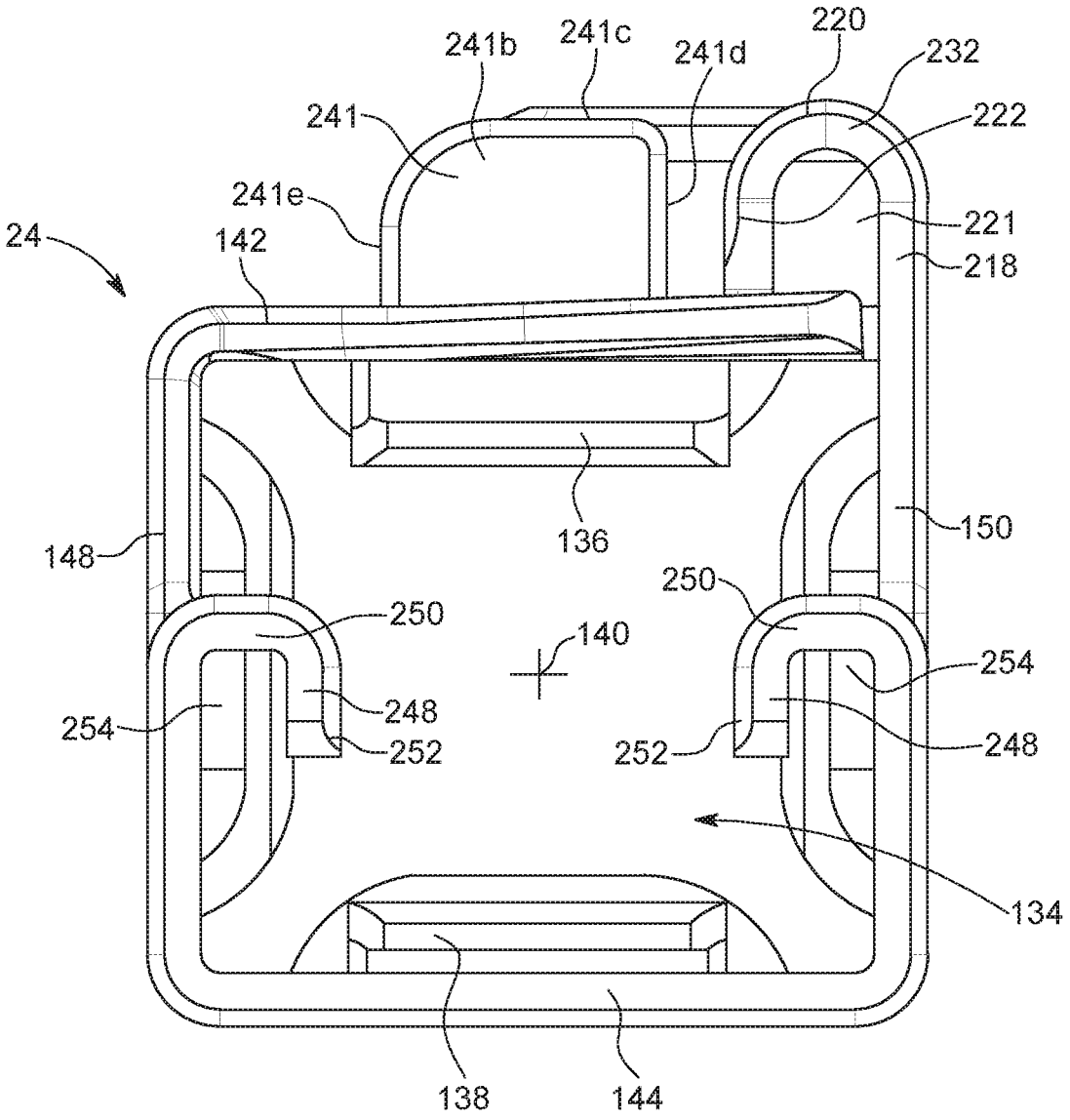
FIG. 24 is a rear elevation view of the hood.
Figure 25:
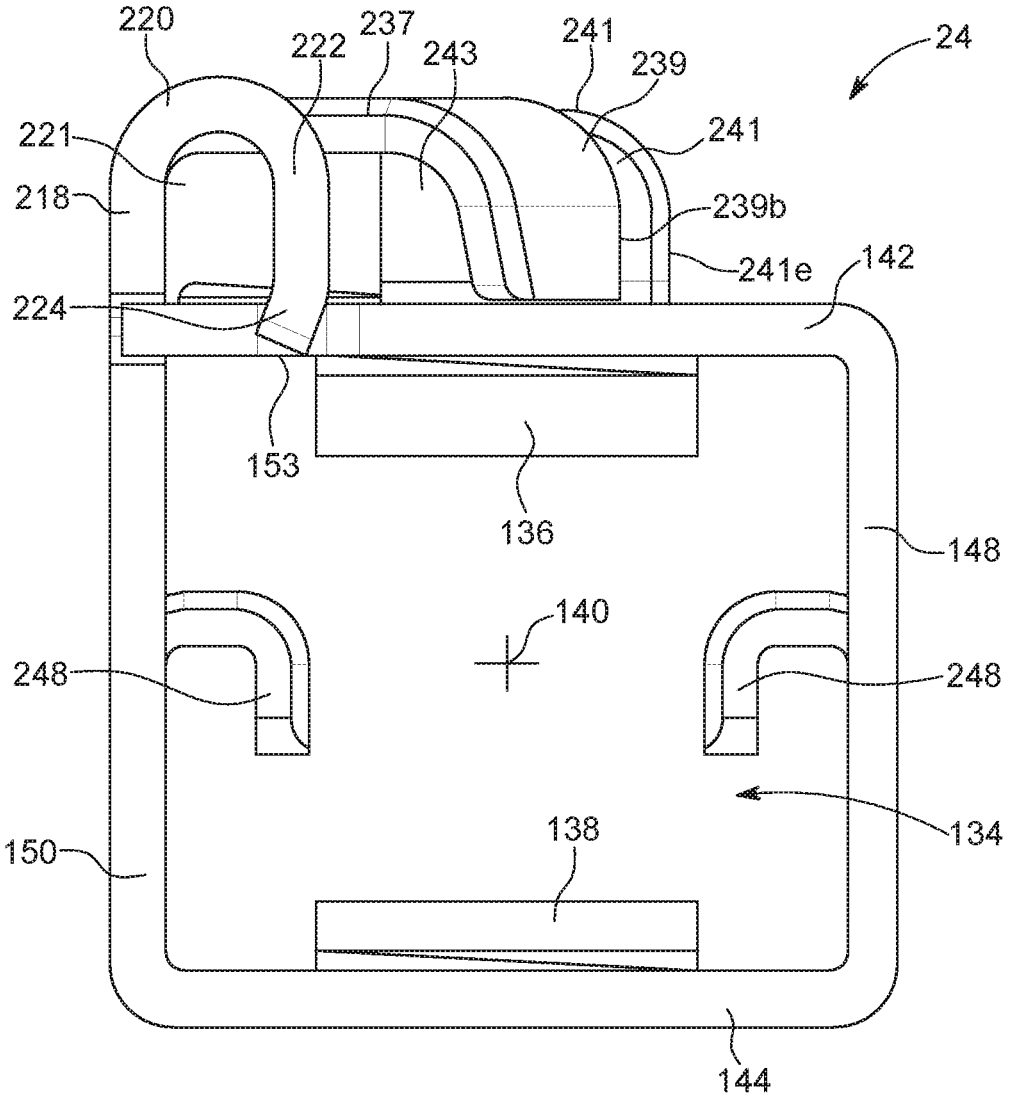
FIG. 25 is a cross-sectional view of the hood along line 25-25 of FIG. 20.

As shown in FIGS. 23 and 24, each of the front and rear sections 230, 232 is formed of a folded over wall formed of a first wall portion 218 extending upwardly from the side wall 146, a second wall portion 220 extending from the top end of the first wall portion 218 and inwardly from the first wall portion 218 to overlap a portion of the top wall 142 and to form a 180-degree arc, and a third wall portion 222 extending downwardly from the end of the second wall portion 220 to the top wall 142 such that a passageway 221 is provided therethrough between the front section 230 and the top wall 142 and between the rear section 232 and the top wall 142. The front section 230 further includes a fourth wall portion 224 extending from the lower end of the third wall portion 222 and at an angle relative thereto such that the fourth wall portion 224 extends inwardly toward the centerline 140. In use, the fourth wall portion 224 seats within the top front window 153 which is sized to receive the fourth wall portion 224. In an embodiment, the fourth wall portion 224 has a longitudinal length which is less than the longitudinal length of the walls portions 218, 220, 222. The fourth wall portion 224 forms a retention finger. The rear section 232 does not overlap the rear window 155.

The intermediate section 233 is between the front opening 152 and the rear window 155 and has a first wall portion 235 which extends upwardly from the side wall 146, a second wall portion 237 extending from the top end of the first wall portion 235 and inwardly toward the centerline 140 to overlap a portion of the top wall 142, and a third wall portion 239 extending downwardly from the end of the second wall portion 237 to the top wall 142 and at an angle relative thereto such that the third wall portion 239 extends inwardly toward the centerline 140. The intermediate section 233 is rearward of the front opening 152, but may overlap a rear section of the front opening 152. The second wall portion 239 is coplanar with, or slightly below, the upper surface of second wall portion 220. The second wall portion 239 is parallel to the top wall 142. The second wall portion 239 extends a distance across the top wall 142 which is greater than the distances the front and rear sections 230, 232 extend across the top wall 142. The third wall portion 239 is angled relative to the centerline 140 in the longitudinal direction such that a front end 239*a* of the third wall portion 239 is closer to the side wall 150 than a rear end 239*b* of the third wall portion 239. The portions 235, 237, 239 form a passageway 243 between the intermediate section 233 and the top wall 142. A portion of the passageway 243 aligns with the passageway 221. In an embodiment, the first wall portions 218, 235 are continuous. In an embodiment, the second wall portions 220 and a portion of the second wall portion 237 which aligns with the second wall portions 220 are continuous.

A strengthening tab 241 extends upwardly from the top wall 142 at the front edge 155*a* of the rear window 155 and extends across the front edge 155*a* of the rear window 155. The tab 241 is perpendicular to the centerline 140. The tab 241 has a front face 241*a*, a rear face 241*b*, and upper and side edges 241*c*, 241*d*, 241*e* extending between the front and rear faces 214*a*, 214*b*. The upper edge 241*c* of the tab 241 is flush with, or slightly below, the upper surface of the second wall portion 237 of the intermediate section 233. The front face 241*a* is proximate to, and may abut against, the rear end 232*b* of the rear section 232. In an embodiment, the tab 241 is bent out of the top wall 142 of the hood 24. In an embodiment, the tab 241 is generally rectangular.

Figure 20:
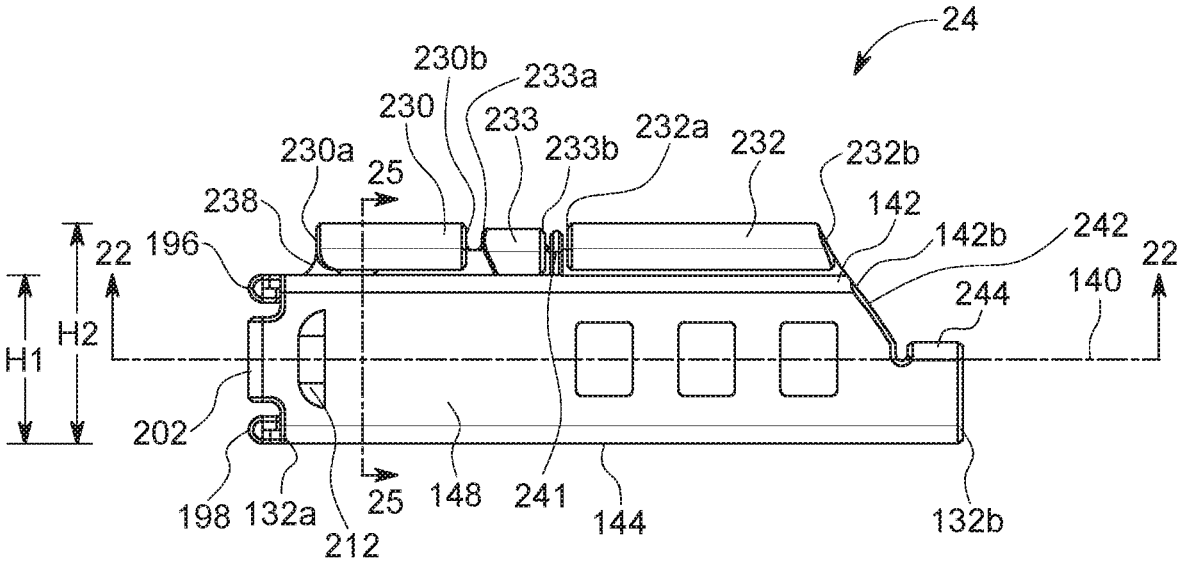
FIG. 20 is a side elevation view of the hood.
Figure 21:
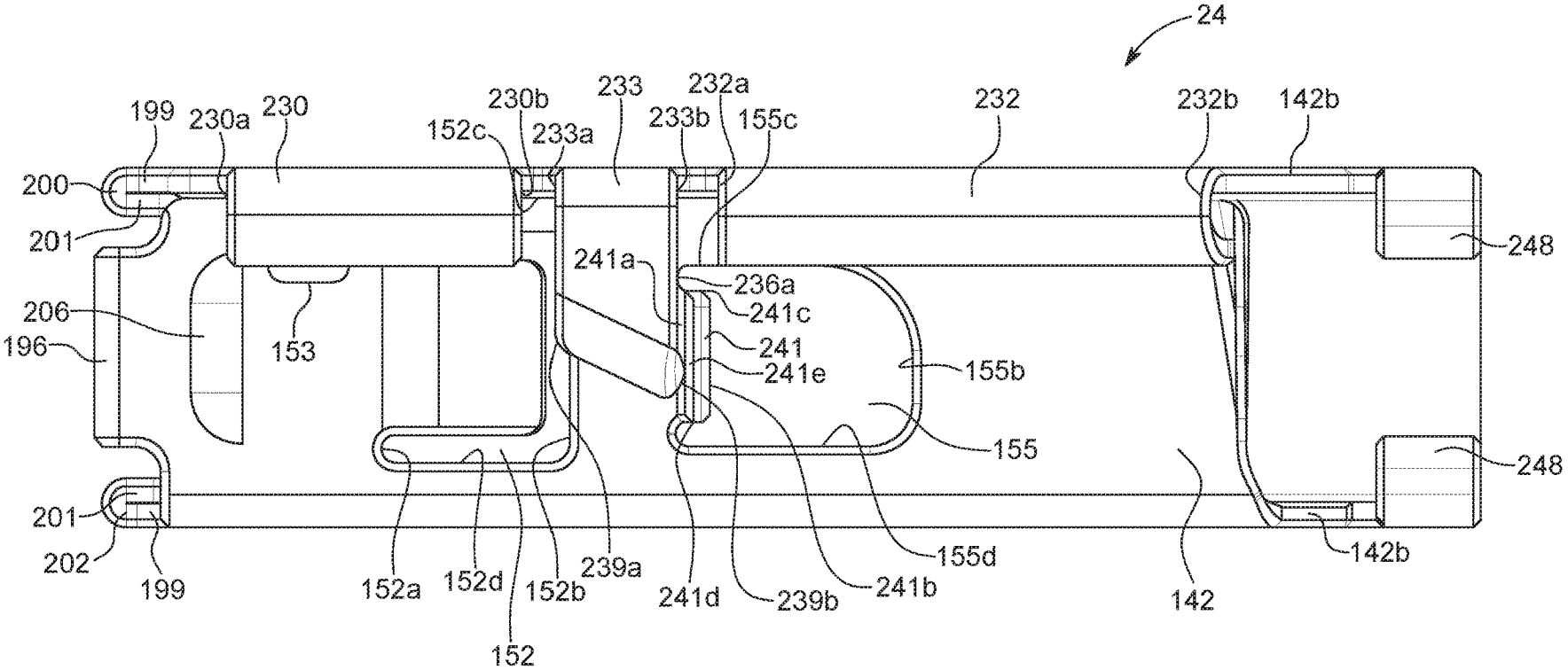
FIG. 21 is a top plan view of the hood.
Figure 22:
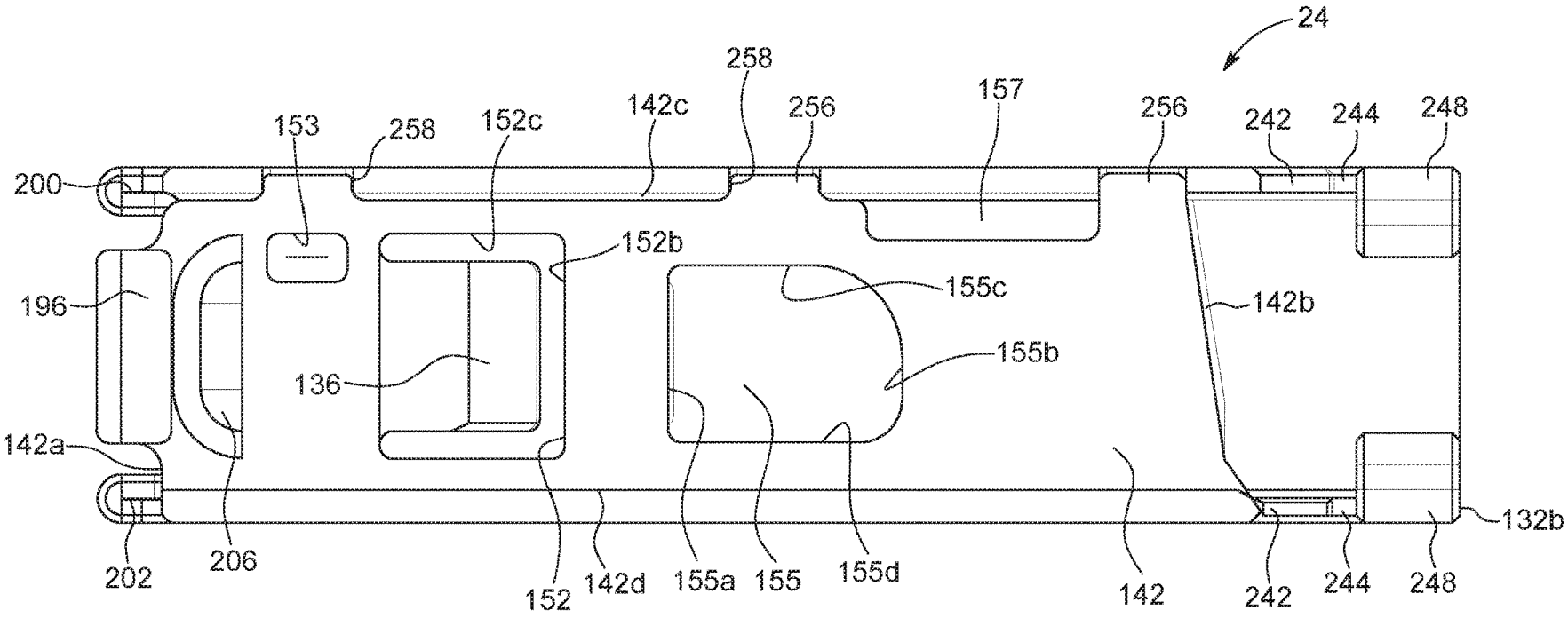
FIG. 22 is a cross-sectional view of the hood along line 22-22 of FIG. 20.

As shown in FIG. 20, a first height H1 is defined and is measured from the exterior surface of the top wall 142 to the exterior surface of the bottom wall 144. A second height H2 is defined and is measured from the exterior surface of the bottom wall 144 to the planar upper surface 216 of the alignment rib 214. Height H2 is greater than height H1, but is not substantially greater.

Each side wall 146, 148 has a plurality of spaced apart windows 240 therethrough which are configured to mate with the protrusions 64 on the side walls of the contact 22. The windows 240 are rearward of the stiffening beams 136, 138. In an embodiment, the windows 240 in the side wall 146 are aligned with the windows 240 in the side wall 148.

The rear edge 142*b* of the top wall 142 is longitudinally spaced from the rear end 132*b* of the body 132. An upper portion 242 of each rear end 146*b*, 148*b* of the side walls 146, 148 extends at an angle relative to the centerline 140 and extends downwardly and rearwardly from the rear edge 142*b* of the top wall 142 toward the rear end 132*b* of the body 132. A lower portion 244 of each rear end 146*b*, 148*b* of the side walls 146, 148 extends parallel to the centerline 140. As such, the angled upper portion 242 is spaced from the rear end 132*b* of the body 132. The angled surfaces provided by the rear end 214*b* of the alignment rib 214, the rear edge 142*b* of the top wall 142 and the angled upper portion 242 of the rear end 146*b*, 148*b* of the side walls 146, 148 provides a smooth taper and eliminates any sharp corners.

In an embodiment, the lower portion 244 of each side wall 146, 148 includes a wall forming a folded over tab 248 which extends into the passageway 132. Each tab 248 includes a U-shaped first wall portion 250 which extends inwardly from the respective side wall 146, 148 and into the passageway, and a second wall portion 252 which extends downwardly from the first wall portion 250. A space 254 is formed by the portions 250, 252 of each tab 248.

To assemble the contact 22 with the hood 24, the hood 24 is first in a partially formed condition. In this partially formed condition, the top wall 142 is partially bent relative to the side wall 148, the stiffening beam 136 is not bent relative to the top wall 142, the stiffening beam 138 is not bent relative to the bottom wall 144, the front section 230 of the alignment rib 214 is partially bent relative to the side wall 146, the side walls 146, 148 are partially bent relative to the bottom wall 144, and the tabs 248 are not bent. The remaining features are formed on the hood 24.

The front end of the contact 22 is inserted through the opening formed at the rear end 132*b* of the body 132 of the hood 24 and is slid along the partially formed passageway 134 until the front end 32*a* of the body 32 of the contact 22 engages with the rear faces of the projections 208, 210, 212 on the walls 144, 146, 148. The projections 208, 210, 212 act as a stop which limits the further insertion of the contact 22 into the hood 24. Thereafter, the side walls 146, 148 are further bent relative to the bottom wall 144 to the vertical position, and the top wall 132 is further bent relative to the side wall 148 to a horizontal position. During this bending, the top wall 142 engages with side wall 146. The top wall 142 may have tabs 256 which seat within openings 258 in the side wall 146 which secures the top wall 142 to the side wall 146. When the walls 142, 146, 148 are bent, the projections 206, 208, 210, 212 fully engage the front end 32*a* of the body 32 of the contact 22. In addition, when the walls 142, 146, 148 are bent, the protrusions 64 seat within the windows 240 and the flange 65 is passed through the window 157 of the top wall 142 and into the passageway 221 of the rear section 232. Thereafter the stiffening beams 136, 138 are bent inwardly to engage the contact beams 36, 136. The front section 230 of the alignment rib 214 is then bent relative to the side wall 146 and the top wall 144. The fourth wall portion 224 seats within the front window 153 in the top wall 142 to further secure the alignment rib 214 and the top wall 142 together. The tabs 248 are folded over and engage with the notches 82. The innermost surfaces of the projections 206, 208, 210, 212 of the hood 24 are flush with or substantially flush with the interior surfaces of the walls 42, 44, 48, 50.

The engagement of the protrusions 64 within the windows 240, the flange 65 through the window 157 and into the passageway 221, the fourth wall portion 224 within the front window 153, and the tabs 248 within the notches 82 all serve to secure the contact 22 within the hood 24, to maintain and lock the contact 22 within the hood 24, thereby preventing separation of the contact 22 and the hood 24, resist pullout when the contact 22 is acted upon by a withdrawing force.

While the protrusions 64 are described as being on the contact 22 and the windows 240 in the hood 24, the protrusions 64 can be provided on the hood 24 and the windows 240 formed in the contact 22.

The electrical terminal 20 and its attached lead wire 420 are mounted within the connector assembly 620 as described herein.

Figure 26:
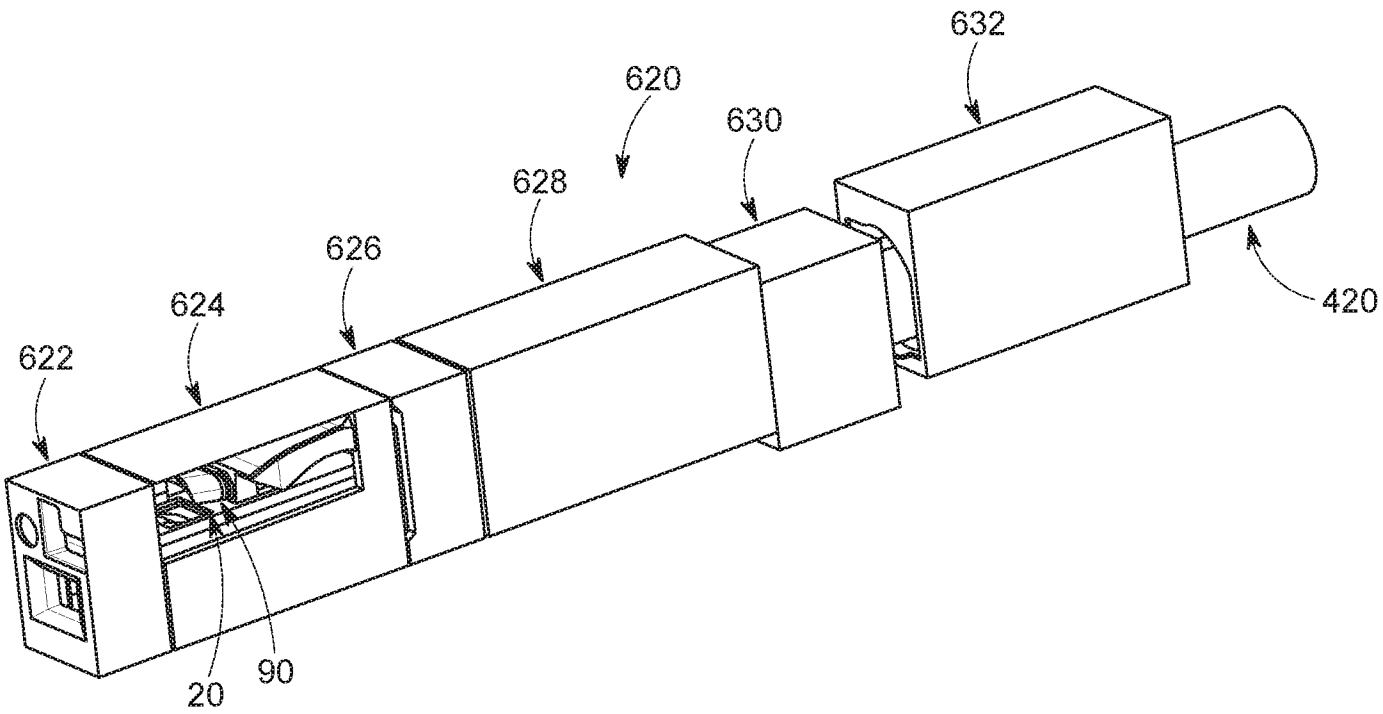
FIG. 26 is a front perspective view of a contact assembly in which the connector assembly is mounted.
Figure 27:
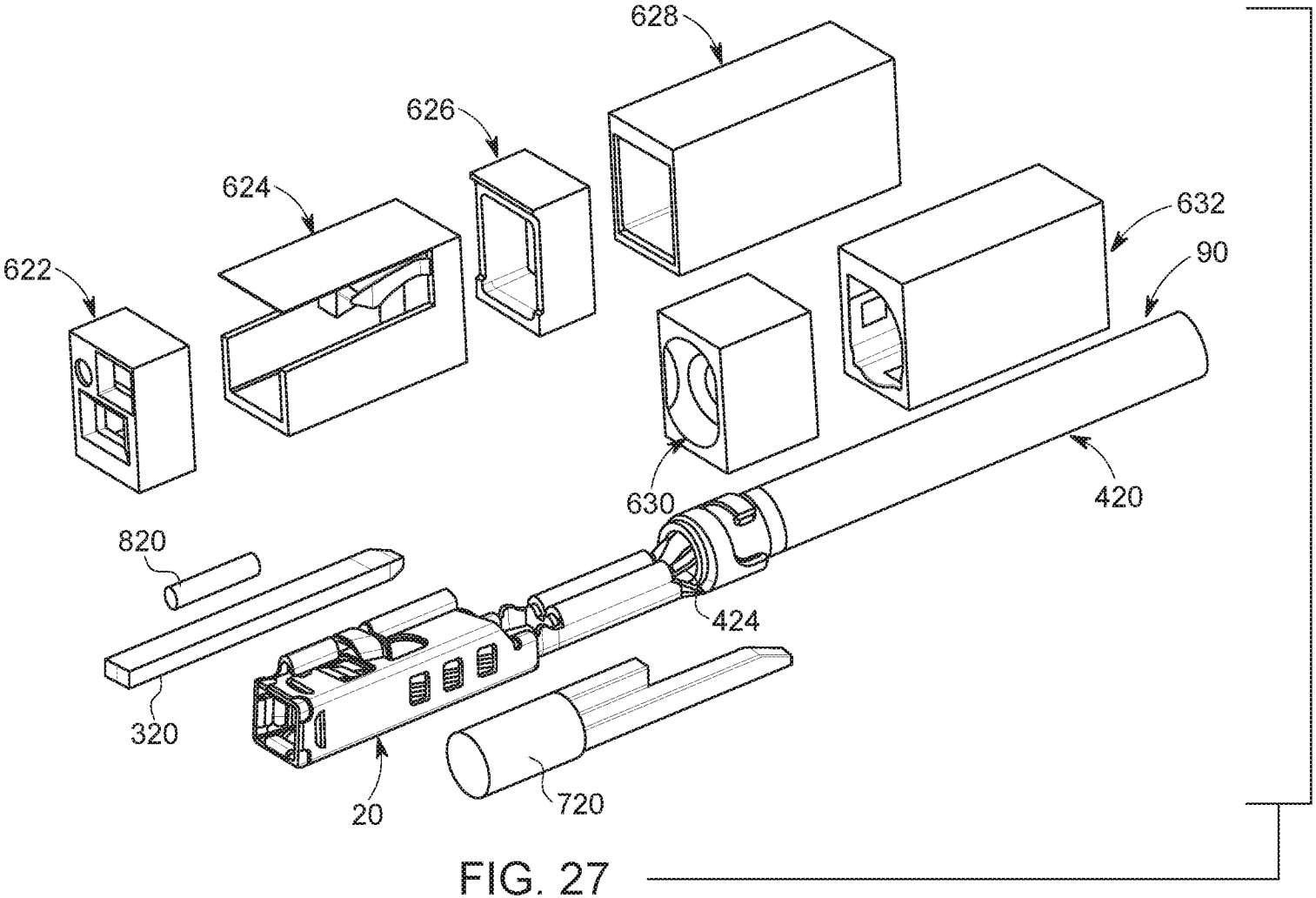
FIG. 27 is a front perspective view of the connector assembly, the contact assembly, a male terminal, a retracting tool and a probe, shown exploded from each other.
Figure 28:
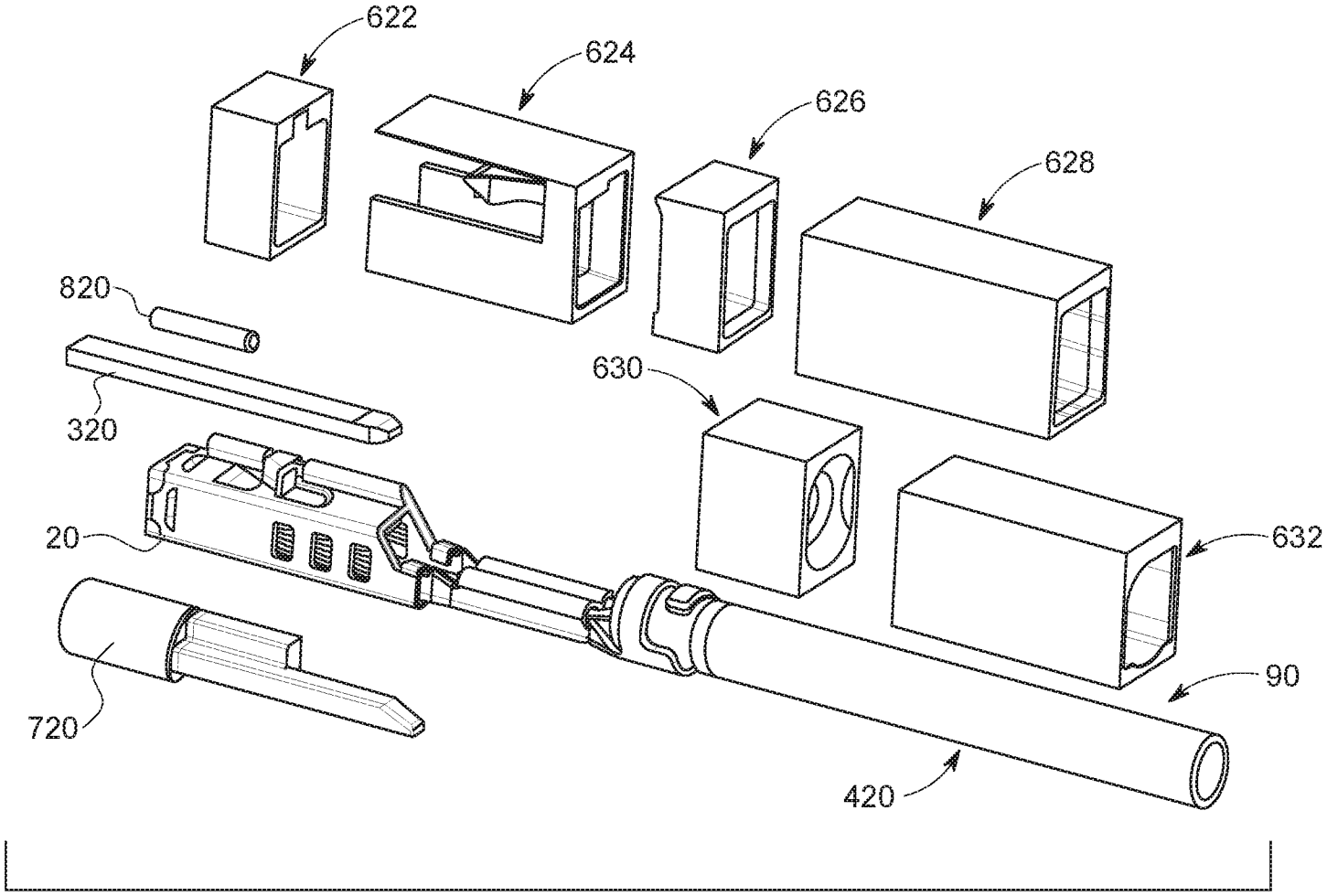
FIG. 28 is a rear perspective view of the connector assembly, the contact assembly, the male terminal, the retracting tool and the probe, shown exploded from each other.
Figure 29:
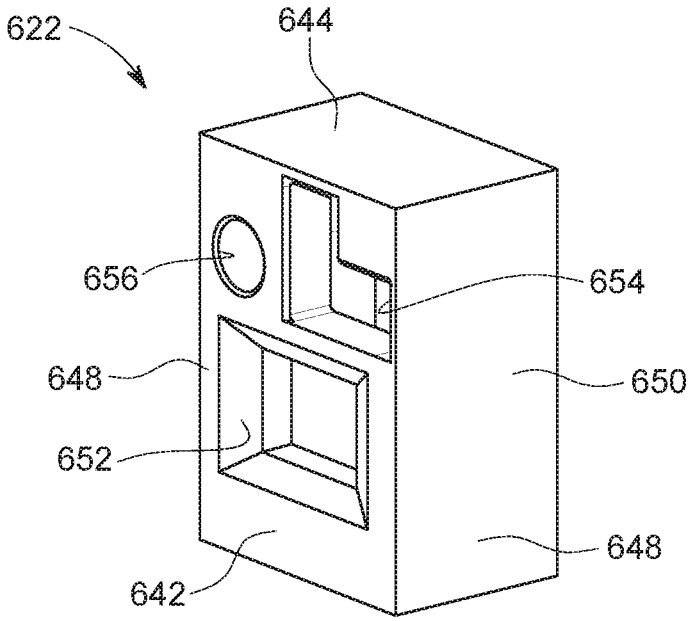
FIG. 29 is a front perspective view of a front cover of the connector assembly.
Figure 30:
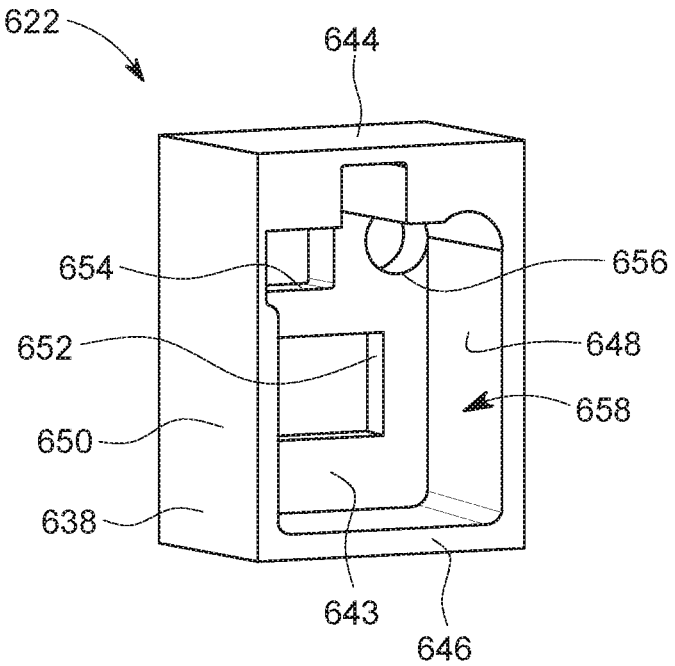
FIG. 30 is a rear perspective view of the front cover.
Figure 31:
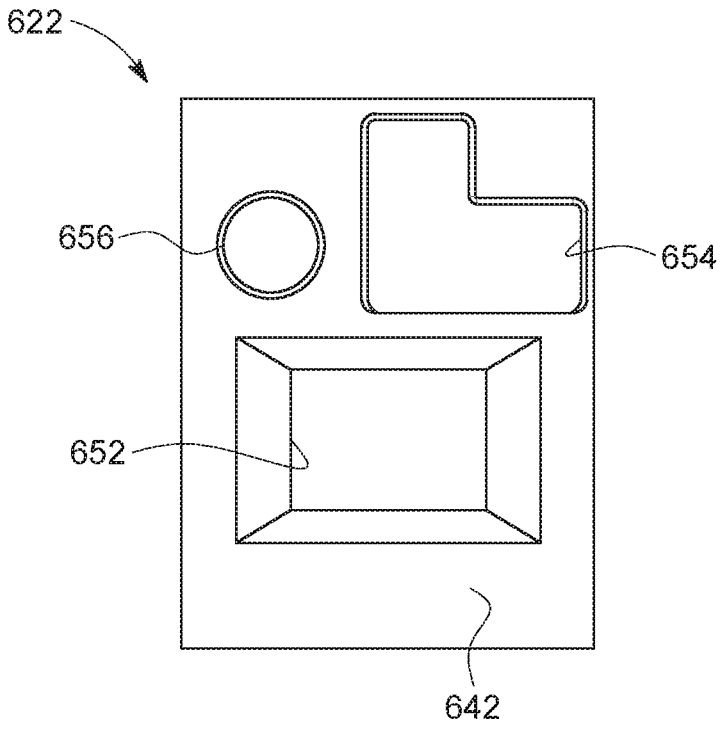
FIG. 31 is a front elevation view of the front cover.
Figure 32:
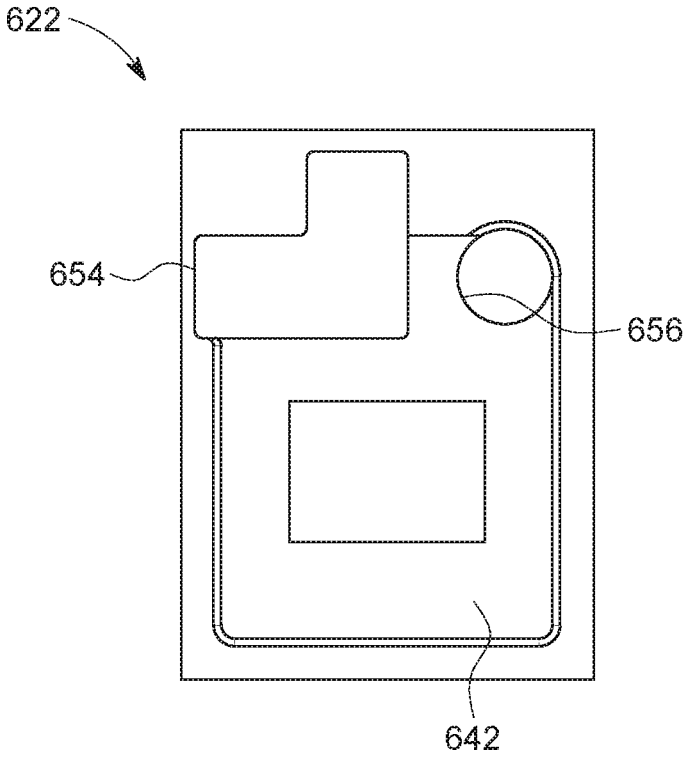
FIG. 32 is a rear elevation view of the front cover.

As shown in FIGS. 26-28, the connector assembly 620 includes a front cover 622, a front housing 624 disposed rearward of the front cover 622, an independent secondary lock 626 disposed rearward of front housing 624, a rear housing 628 disposed rearward of the independent secondary lock 626, a seal 630 disposed rearward of the rear housing 628, and a seal cover or grommet cover 632 disposed rearward of the seal 630.

As shown in FIGS. 29-32, the front cover 622 is formed of a body 638 having a front wall 642 having a rear surface 643, opposite top and bottom walls 644, 646 extending rearwardly from the front wall 642, and first and second upright side walls 648, 650 extending rearwardly from the front wall 642 and extending between the top and bottom walls 644, 646. A male terminal receiving passageway 652, a tool receiving passageway 654 and a probe receiving passageway 656 extend through the front wall 642 and through the space 658 formed by the walls 644, 646, 648, 650. The male terminal receiving passageway 652 is sized to receive the male terminal 320 therethrough. The tool receiving passageway 654 is sized to receive a retracting tool 720 therethrough. The probe receiving passageway 656 is sized to receive a probe 820 therethrough. The male terminal receiving passageway 652 is positioned below the tool receiving passageway 654 and the probe receiving passageway 656.

Figure 33:
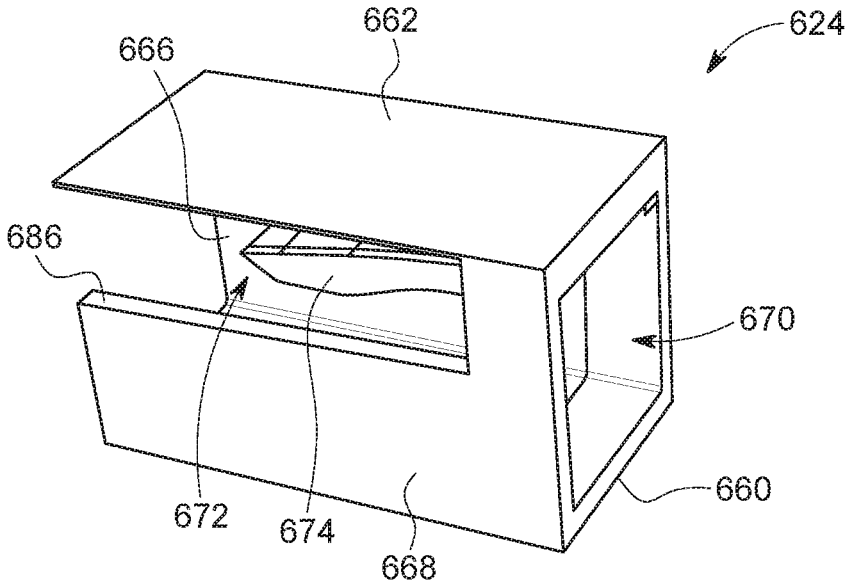
FIG. 33 is a front perspective view of a front housing of the connector assembly.
Figure 34:
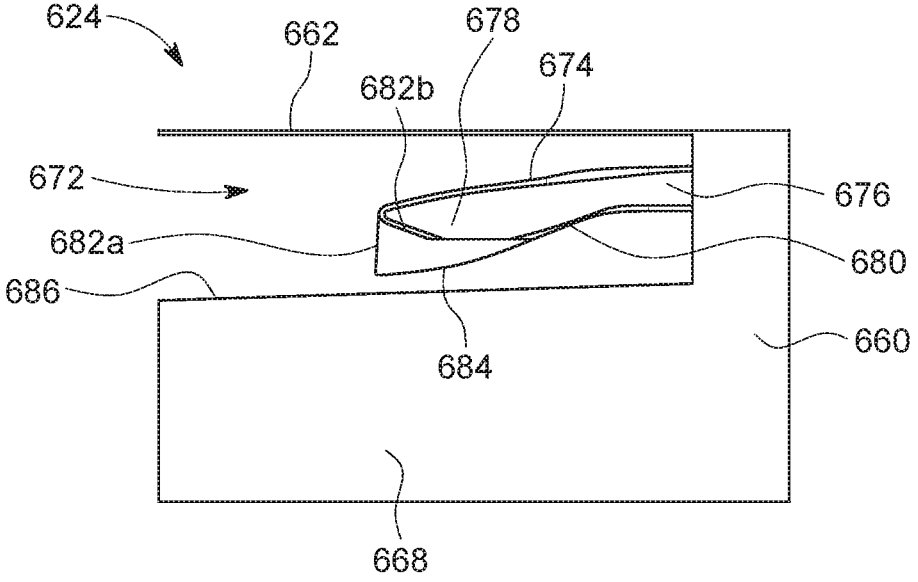
FIG. 34 is a side elevation view of the front housing.
Figure 35:
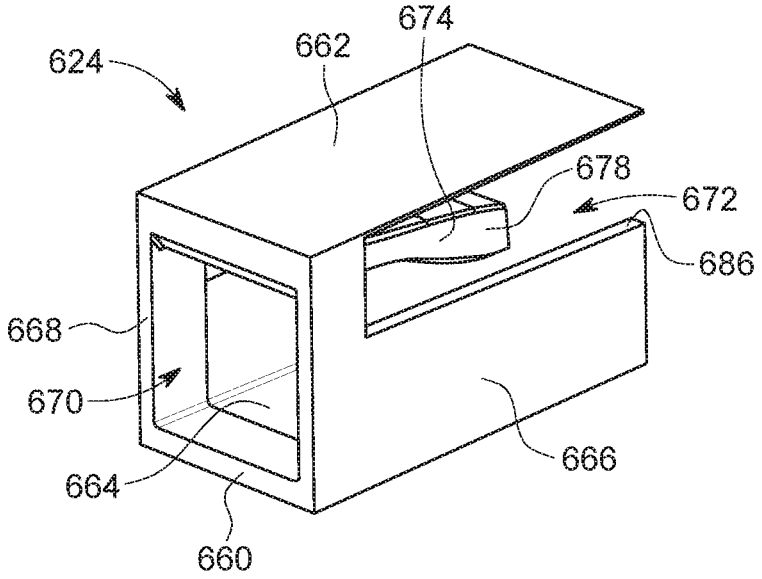
FIG. 35 is a rear perspective view of the front housing.

As shown in FIGS. 33-35, the front housing 624 is formed of a rear wall 660, opposite top and bottom walls 662, 664 extending forwardly from the rear wall 660, and first and second upright side walls 666, 668 extending forwardly from the rear wall 660 and extending between the top and bottom walls 662, 664. A passageway 670 extends through the rear wall 660 and through the space 672 formed by the walls 644, 646, 648, 650. A profiled retention beam or retention finger 674 extends from the top wall 662 downwardly into the space 672. The retention finger 674 has a body portion 676 with an enlarged head 678 at the end of the body portion 676. The body portion 676 has a curved lower surface 680. The head 678 has a front surface portion 682*a* which is substantially vertical, a front surface portion 682*b* which is angled, and a bottom surface 684 which is substantially horizontal. Aligned openings 686 are provided in the side walls 666, 668 which extend from the rear wall 660 forwardly.

Figure 36:
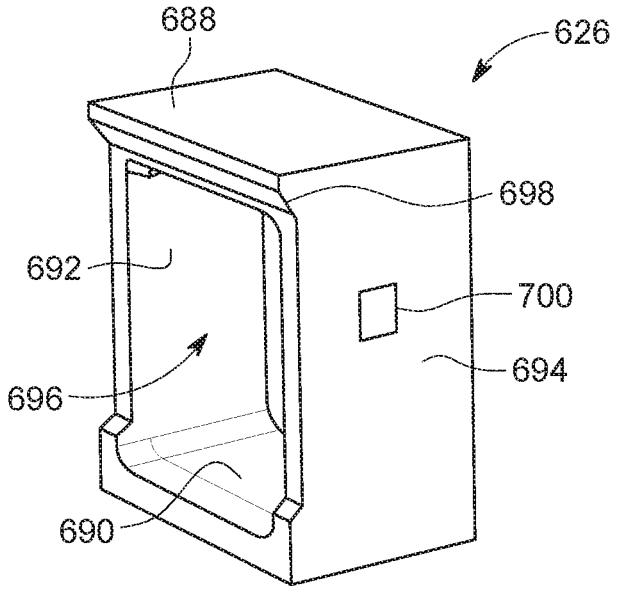
FIG. 36 is a front perspective view of an independent secondary lock of the connector assembly.
Figure 37:
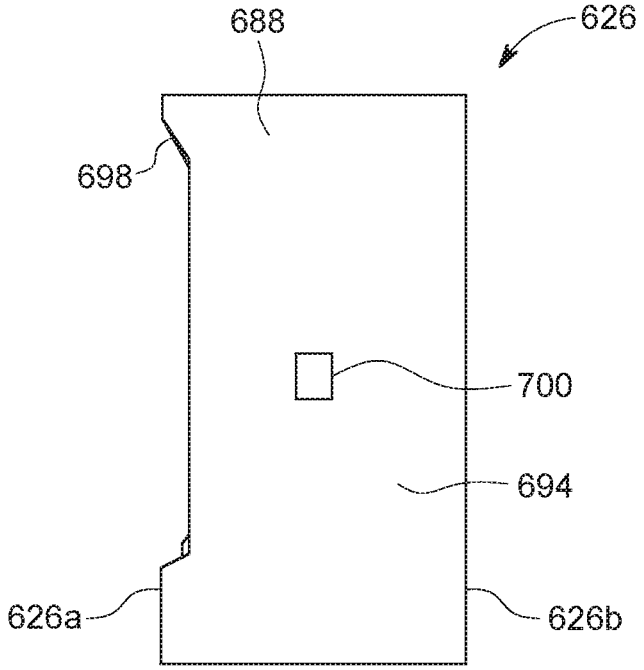
FIG. 37 is a side elevation view of the independent secondary lock.

As shown in FIGS. 36 and 37, the independent secondary lock 626 is formed of opposite top and bottom walls 688, 690 which are separated from each other by side walls 692, 694 and define a central passageway 696 which extends therethrough from a front end 626*a* to a rear end 626*b* of the independent secondary lock 626. The top wall 688 has a front angled face 698. The face 698 extends rearwardly from the front end 626*a*. The face 698 is angled at the same, or substantially the same angle as the angle at which the upper portion 242 of each rear end 146*b*, 148*b* of the side walls 146, 148 of the hood 24 is angled. The independent secondary lock 626 is positioned rearward of the front housing 624. The independent secondary lock 626 can be moved vertically relative to the front housing 624 and can be locked into place relative to the front housing 624 by cooperating locking features 700 (which are only shown on the independent secondary lock 626) provided on the independent secondary lock 626 and on the front housing 624 to place the independent secondary lock 626 into a locked position. Examples of locking features include, but are not limited to, detents, levers, latches. A user can grasp the independent secondary lock 626 through the openings 686 in the front housing 624 to affect movement of the independent secondary lock 626 relative to the front housing 624.

The rear housing 628 is formed of a body having a passageway therethrough.

Figure 38:
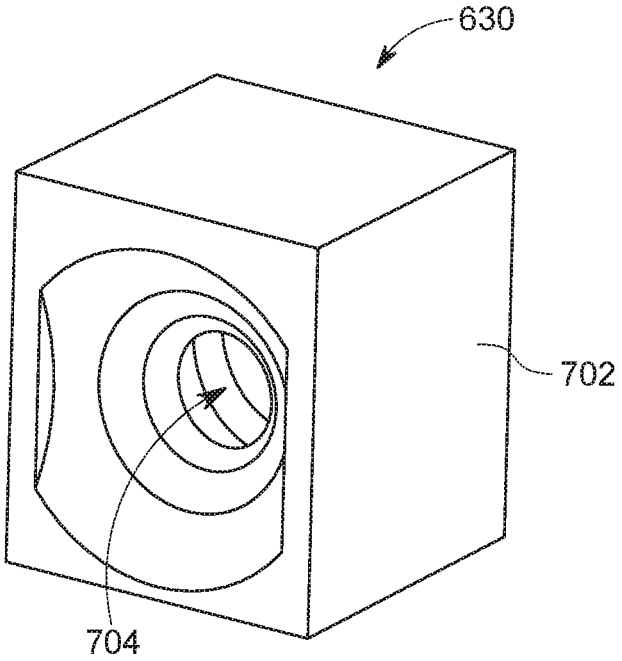
FIG. 38 is a front perspective view of a seal of the connector assembly.
Figure 39:
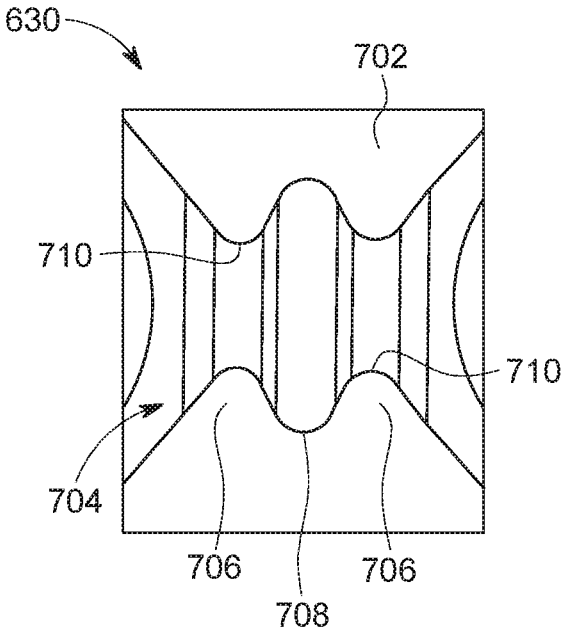
FIG. 39 is a cross-sectional view of the seal.
Figure 40:
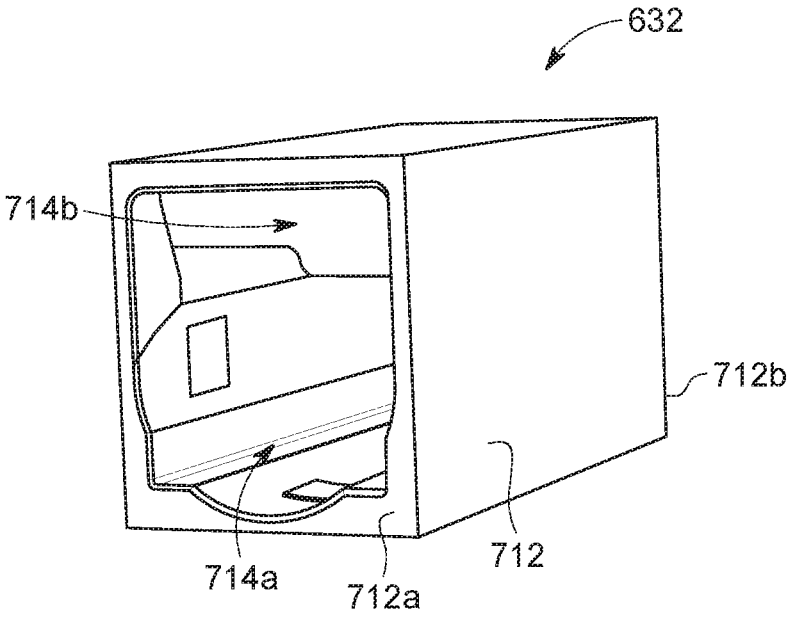
FIG. 40 is a front perspective view of a seal cover or grommet cover of the connector assembly.
Figure 41:
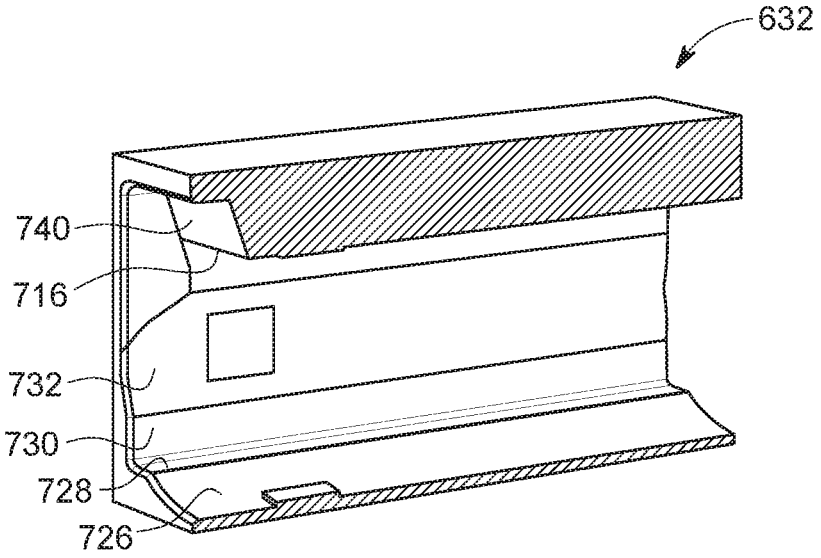
FIG. 41 is a cross-sectional view of the seal cover or grommet cover shown in perspective.
Figure 42:
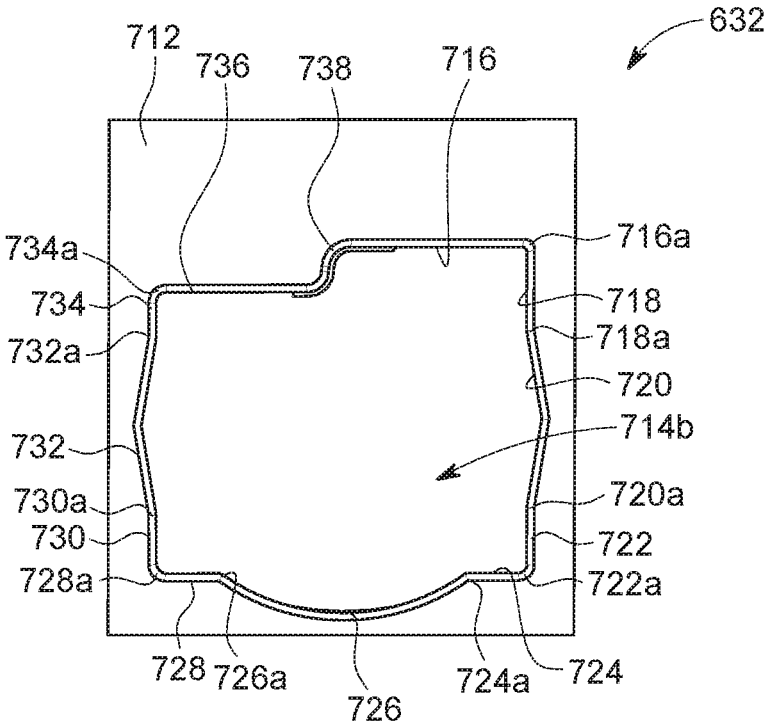
FIG. 42 is a rear elevation view of the seal cover or grommet cover.
Figure 43:
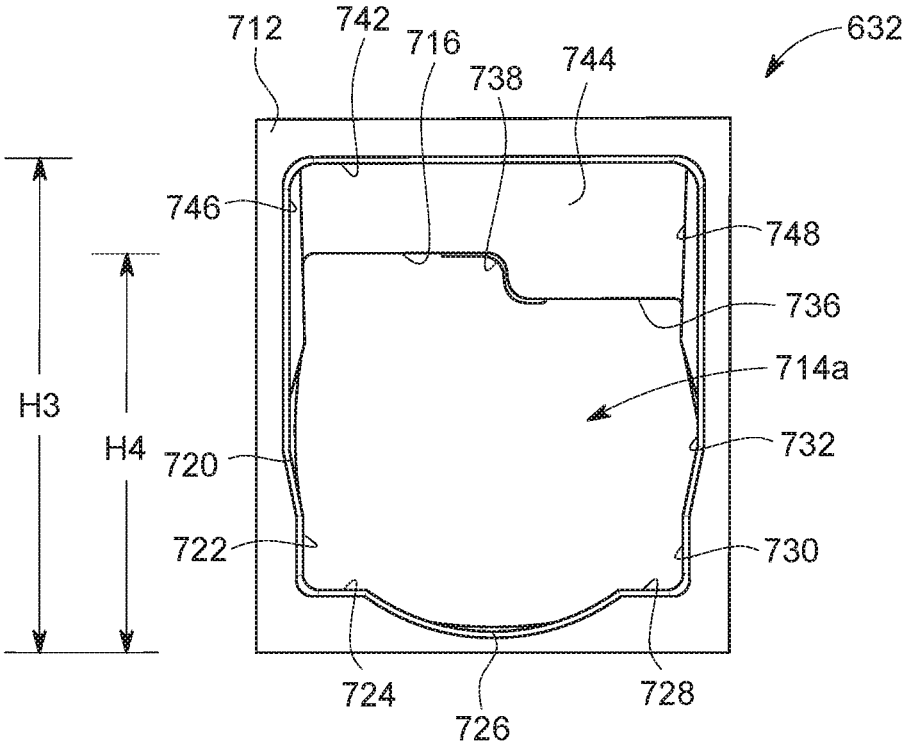
FIG. 43 is a front elevation view of the seal cover or grommet cover.

As shown in FIGS. 38 and 39, the seal 630 is formed of a compliant resilient material, such as rubber, and is configured to engage the insulative covering 422 of the lead wire 420 when the lead wire 420 is inserted therethrough as described herein. The seal 630 is formed of a wall 702 having a central aperture or passageway 704 extending therethrough from a front end 702*a* of the wall 702 to a rear end 702*b* of the wall 702. In an embodiment, the surface forming the passageway 704 is formed as a plurality of compressible lobes, lips or bladders 706 having a lobe 708 therebetween. The bladders 706 define innermost surfaces 710 of reduced dimension of the passageway 704. In an embodiment, the innermost surfaces 710 are circular in shape. The innermost surfaces 710 of the passageway 704 define a dimension which is less than the exterior dimension of the electrical terminal 20, and which is less than the diameter of the insulative covering 422 of the lead wire 420. The seal 630 provides a resilient interface with the insulative covering 422 of the lead wire 420 to provide a moisture/debris resistant barrier.

As shown in FIGS. 40-43, the seal cover or grommet cover 632 is formed of a body 712 having a front passageway portion 714*a* extending from a front end 712*a* of the body 712 to a rear passageway portion 714*b* which extends to the rear end 712*b* of the body 712. The front and rear passageway portions 714*a*, 714*b* are sized to allow the electrical terminal 20 to pass therethrough and to allow the insulative covering 422 to pass therethrough without significant resistance. The rear passageway portion 714*b* has a first, upper surface 716 which is horizontal and extends partially across the body 712, a second, side surface 718 extending vertically downwardly from an outer end 716*a* of the upper surface 716, a third, side surface 720 extending vertically downwardly from a lower end 718*a* of the side surface 718, the side surface 720 being curved, a fourth, side surface 722 extending vertically downwardly from a lower end 720*a* of the side surface 720, a fifth, lower surface 724 extending horizontally from a lower end 722*a* of the side surface 722, the fifth surface 724 being parallel to, and underneath, the upper surface 716, a sixth, lower surface 726 extending from the end 724*a* of the lower surface 724, the side surface 726 being curved, a seventh lower surface 728 extending horizontally from the end 726*a* of the lower surface 726, the seventh surface 728 being aligned with the lower surface 724, an eighth, side surface 730 extending vertically upwardly from an end 728*a* of the lower surface 728 and being parallel to and aligned with the side surface 722, a ninth, side surface 732 extending from the end 730*a* of the side surface 730, the side surface 732 being curved, a tenth, side surface 734 extending vertically upwardly from the end 732*a* of the side surface 732, the side surface 734 being aligned with the side surface 730 and with the side surface 718, an eleventh, upper surface 736 extending horizontally from the upper end 734*a* of the side surface 734 and toward the upper surface 716, the upper surface 734 being parallel to, but vertically offset below, the upper surface 716, a twelfth upper surface 738 which is generally formed as an "S" or "Z" shape, which connects the upper surfaces 716, 736 together. The surfaces 720, 726, 732 fall along an imaginary circle. The surfaces 718, 722, 724, 728, 730, 734, 736 correspond to the shape of the body 132 of the hood 24, and the body 132 of the hood 24 passes through these surfaces 718, 722, 724, 728, 730, 734, 736 during insertion of the contact assembly 90 therethrough. The surfaces 716, 718, 738 form a keyway of the passageway 720 and correspond to the shape of the alignment rib 214 and the alignment rib 214 of the hood 24 passes through these surfaces 716, 718, 738 during insertion of the contact assembly 90 therethrough. The insulative covering 422 passes through these surfaces 720, 726, 732 during insertion of the contact assembly 90 therethrough. The surfaces 720, 722, 724, 726, 728, 730 extend from the front end 712*a* of the body 712 to the rear end 712*b* of the body 712 such that these surfaces 720, 722, 724, 726, 728, 730 also extend through the front passageway portion 714*a*. The front ends of the surfaces 716, 736, 738 are spaced from the front end 712*a* of the body 712 such that a front recess 740 is formed in the body 712 which forms an upper portion of the front passageway portion 714*a*. The front recess 740 is formed from an upper wall 742 which extends from the front end 712*a* of the body 712 to a rear wall 744 extending upwardly from the front end of the surfaces 716, 736, 738, and side walls 746, 748 which extend from the front end 712*a* of the body 712 to the rear wall 744. The front recess 740 causes the front passageway portion 714*a* to have a height H3 (the distance between the surface 726 and the surface 742) which is greater than a height H4 (the distance between the surface 726 and the surface 716) of the rear passageway portion 714*b*, see FIG. 43.

To assemble the contact assembly 90 with the connector assembly 620, the electrical terminal 20 is inserted into and through the seal cover or grommet cover 632. The electrical terminal 20 can only be inserted in one way into the seal cover or grommet cover 632 since the alignment rib 214 must seat within the keyway formed by the surfaces 716, 718, 738. This seating of the alignment rib 214 within the keyway acts as a polarization feature to properly align the electrical terminal 20 within the seal cover or grommet cover 632, to prevent the electrical terminal 20 from rotating within the seal cover or grommet cover 632, and to provide a guiding feature within the seal cover or grommet cover 632.

Figure 44:
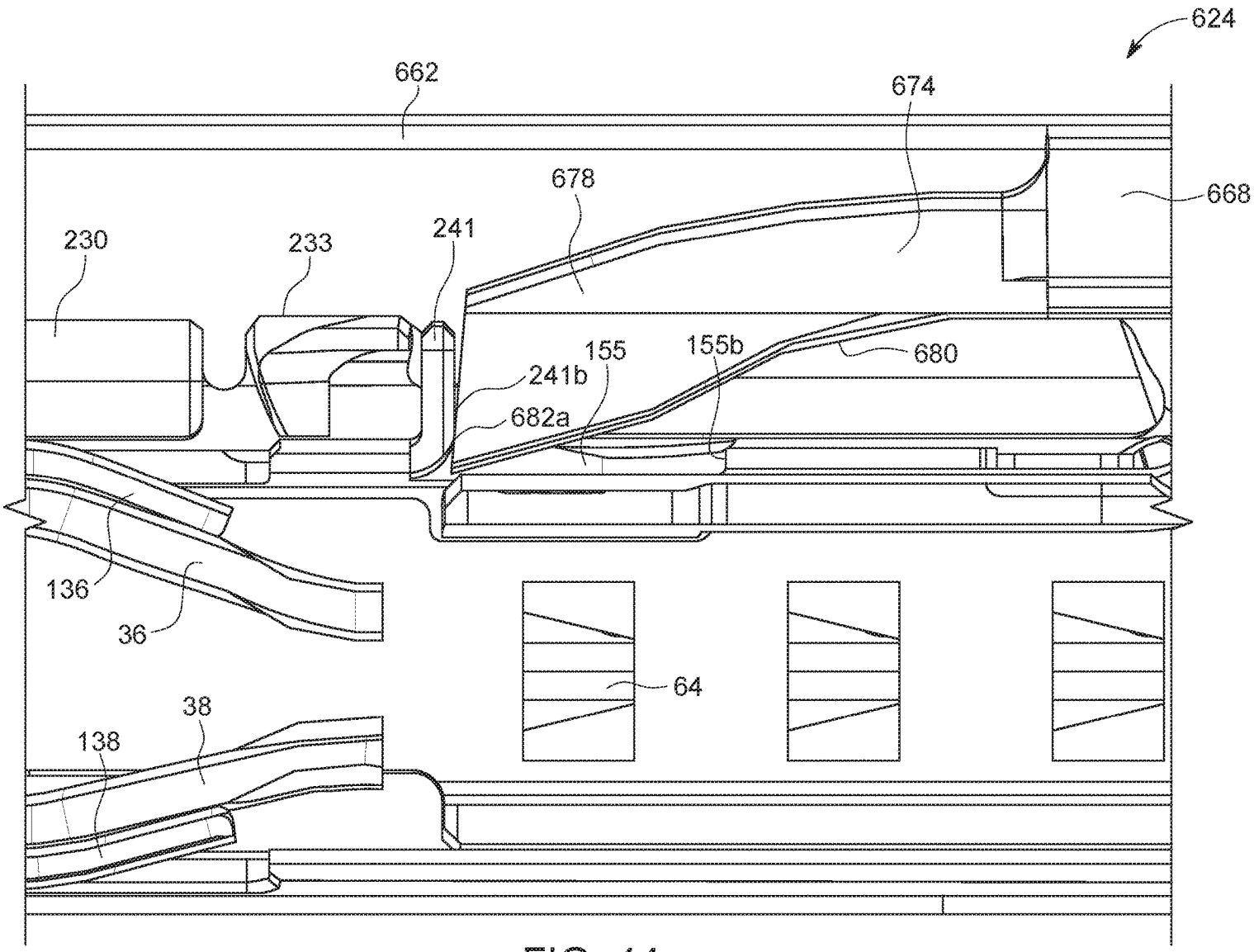
FIG. 44 is a partial cross-sectional view of the connector assembly and contact assembly in an assembled condition.

Thereafter, the electrical terminal 20 is passed through the passageway 704 of the seal 630. As the electrical terminal 20 passes through seal 630, the front end 132*a* of the body 132 first engages with the innermost surfaces 710 and expands the seal 630 outwardly. The flanges 196, 198, 200, 202 assist in reducing any tear risk of the seal 630 upon contact with the hood 24. The bladders 706 of the seal 630 compress to conform to the exterior shape of the hood 24. As the contact assembly 90 continues to be passed through, the front end 214*a* of the alignment rib 214 next contacts the bladders 706 of the seal 630. The height H2 o the combined body 132 and alignment rib 214 is greater than the height H1 of the body 132 alone, however, the height difference is small. Therefore, when the seal 302 further expands to accommodate the increased height H2 over height H1, the seal 602 is not significantly further expanded and therefore the risk of any tearing of the seal 602 is minimal. As the contact assembly 90 passes through the seal 602, when the insulative covering 422 is within the seal 630, the seal 630 contracts and the bladders 706 engage and seal with the insulative covering 422. The electrical terminal 20 then passes into and through the passageway in the rear housing 628 and then into and through the passageway 696 in the independent seal lock 626. When the independent seal lock 626 is in an unlocked position, the contact assembly 90 can freely pass therethrough. The electrical terminal 20 then passes into the passageway 670 of the front housing 624 until the retention finger 674 on the front housing 624 seats within the rear window 155 in the electrical terminal 20 and the front ends of the flanges 196, 198, 200, 202 of the contact assembly 90 engage against the rear face 643 of the front cover 622. During this, the bottom surface 684 of the head 678 of the retention finger 674 engages the top wall 142 of the hood 24 and deflects. Thereafter, the bottom surface 684 of the head 678 continues to slide along the top wall 142 until the head 678 is above the rear window 155. The retention finger 674 resumes its original shape and the head 678 seats within the rear window 155 in the hood 24. The front surface portion 682*a* of the head 678 engages against the rear face 241*b* of the tab 241, see FIG. 44. The engagement of the retention finger 674 within the rear window 155 and against the tab 241, and the engagement of the front ends of the flanges 196, 198, 200, 202 of the contact assembly 90 with the rear face 643 of the front cover 622 prevent the further insertion of the electrical terminal 20 into the contact assembly 90 and also prevent the removal of the electrical terminal 20 from the contact assembly 90. The engagement of the retention finger 674 against the tab 241 also provides added strength and increases the resistance to pull out of the electrical terminal 20 from the contact assembly 90.

When the contact assembly 90 is in the unlocked position within the connector assembly 1020, the insulative covering 422 of the lead wire 420 is engaged with the bladders 706 of the seal 602. After the contact assembly 90 is inserted, the independent secondary lock 626 is moved transversely relative to the centerline 140 of the hood 24 until the angled wall 698 on the independent secondary lock 626 engages against the angled upper portion 242 of each rear end 146*b*, 148*b* of the side walls 146, 148 of the hood 24. The independent secondary lock 626 is secured in place by the mating locking feature 700 into the locked position. The independent secondary lock 626 prevents any rearward movement of the electrical terminal 20 and thus prevents the withdrawal of the contact assembly 90 from the connector assembly 620.

The male terminal 320 is then mounted within the connector assembly 620 and the contact assembly 90. The male terminal 320 is inserted into and through the male terminal receiving passageway 652 and the space 658 in the front cover 622. Thereafter, the male terminal 320 passes through the entrance opening 204 of the electrical terminal 20 and the male terminal 320 may engage the flanges 196, 198, 200, 202 on the hood 24 which guide the male terminal 320 into the passageway 134 of the hood 132. As the male terminal 320 is slid further into the hood 24, the male terminal 320 engages the projections 206, 208, 210, 212 which provide a lead in so that the male terminal 320 does not stub during mating. As the male terminal 320 is slid further into the electrical terminal 20, the male terminal 320 passes through the entrance opening 50 of the contact 22. If the male terminal 320 is out of alignment during insertion, the male terminal 320 engages with a dimple 62 which serve to properly align the male terminal 320 in the passageway 134 of the contact 22.

As the male terminal 320 is slid along the passageway 134 of the contact 22, the male terminal 320 engages with the contact beams 36, 38. This causes the contact beams 36, 38 and the stiffening beams 136, 138 to flex outwardly, with the stiffening beams 136, 138 providing support for the contact beams 36, 38 since the stiffening beams 136, 138 are formed of a higher tensile material than the contact beams 36, 38. During this insertion, the rear sections 60 of the contact beams 36, 38 first flex to allow entry of the male terminal 320 and to provide an initially low insertion force. As the male terminal 320 is slid further relative to the beams 36, 136, 38, 138, the intermediate sections 58 of the contact beams 36, 38 and the sections 192 of the stiffening beams 136, 138 flex. If necessary, the front sections 56 of the contact beams 36, 38 can also flex. The beams 36, 136, 38, 138 may flex to the extent that the beams 36, 136, 38, 138 are substantially parallel to the centerlines 40, 140. During insertion of the male terminal 320 into the electrical terminal 20, the higher tensile strength material used to form the stiffening beams 136, 138 increases the normal force for proper electrical connection between the contact beams 36, 38 and the male terminal 320. Therefore, the contact beams 36, 38 can be made of a lower tensile strength material, such as copper, while ensuring that engagement is formed between the male terminal 320 and the contact beams 36, 38. The stiffening beams 136, 138 provide reinforcement to the contact beams 36, 38 and provide additional normal force to counteract the deterioration of the performance of the contact beams 36, 38 over time. In the embodiment shown, the hood 24 does not provide any direct electrical contact 22 with the male terminal 420, but the hood 24 adds greater mechanical properties to improve or enhance the electrical properties of the contact beams 36, 38.

Once the contact assembly 90, the connector assembly 1020 and the male terminal 320 are assembled together, the electrical path can be verified by appropriate testing. This is accomplished by the test probe 820 being inserted through the probe receiving passageway 656 of the front cover 622 and electrical conductivity can be checked by electrically connecting the test probe 820 to the alignment rib 214 on the hood 24 of the electrical terminal 20.

In certain circumstances, the contact assembly 90 may be defective or may need to be serviced. In these circumstances, it is necessary to remove the contact assembly 90 from the connector assembly 620. To remove the contact assembly 90, the independent secondary lock 626 is first moved back from the locked position to the unlocked position so that the contact assembly 90 can be withdrawn back through the independent secondary lock 626. In addition, the retention finger 674 must be deflected out of the rear window 155. This is accomplished by inserting the retracting tool 720 into and through the tool receiving passageway 654 and the space 658 in the front cover 622 and inserting the retracting tool 720 into the space 750 to deflect the retention finger 674 by engaging the front surface portion 682*b*. Once the retention finger 674 is withdrawn from the rear window 155, the contact assembly 90 can be withdrawn from the connector assembly 1020. If a user attempts to withdraw the contact assembly 90 from the connector assembly 520 prior to withdrawal of the retention finger 674 from the rear window 155, the retention finger 674 applies a load on the tab 241 which provides a backup surface that provides additional retention force.

As the contact assembly 90 is withdrawn, the angled upper portion 242 of each rear end 146*b*, 148*b* of the side walls 146, 148 comes into contact with the seal 630. This angled upper portion 242 enlarges the passageway 704 such that tearing of the seal 630 is prevented or avoided. The seal 630 may then be reused upon reinsertion of the repaired contact assembly 90. During this withdrawal, as the seal 630 expands, the seal 630 can expand into the front recess 740 in the body 712 of the seal cover or grommet cover 632, thereby preventing the seal 630 from being pinched by the seal cover or grommet cover 632.

In an embodiment, all edges which form the various features of the contact 22 and the hood 24 that will come into contact with the seal 630 are chamfered to provide surfaces which angle inwardly toward the passageway 34 (even if not specifically described herein) to avoid tearing of the seal 630 when the edge comes into contact with the seal 630. The edges may be rounded. The front edges are smoothed to remove burrs in the metal.

In another embodiment, an electrical connector assembly is contemplated that does require a moisture or debris barrier (not shown). In as such, the connector assembly does not have an elastomeric seal or grommet to retain the seal to the housing. The electrical terminal and attached lead wire simply exits the passageway formed at the rear of the housing.

It should be noted that, in general, the depiction of whether the electrical terminal 20 is a plug type or a receptacle type in the figures is done merely for illustrative purposes. Therefore, it is envisioned that a particular electrical terminal 20 could be configured to be a plug type, or a receptacle type, or a combination of plug and receptacle, as desired. Therefore, unless specifically noted, the determination of whether the electrical terminal 20 is a receptacle or plug is not intended to be limiting.

By providing the two-piece electrical terminal 20, a lower cost electrical terminal 20 is provided since the entire electrical terminal 20 is not formed of the higher cost, highly conductive material.

In addition, since a high tensile strength material, such as stainless steel, is used for the hood 24, the hood 24 can be bent to include the 180-degree bends which is not possible with copper, since copper tends to crack when bent at a 180-degree bend.

The use of the terms "a" and "an" and "the" and "at least one" and similar references in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All processes described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An electrical terminal comprising:

a contact formed of a body having a front end and a rear end, a passageway formed therethrough, and first and second contact beams extending from the body and extending into the passageway; and a hood surrounding the contact, the hood formed of a body having a top wall, a bottom wall and side walls extending between the top and bottom walls such that a front end and a rear end of the body are defined and a passageway is formed therethrough, an alignment rib extending from the top wall, the alignment rib having a front section which extends partially across a top surface of the top wall a first distance, a rear section which extends partially across the top surface of the top wall a second distance, and an intermediate section which extends partially across the top surface of the top wall a third distance, the intermediate section being between the front and rear sections, wherein the third distance is greater than the first or second distances, a window provided through the top wall, and a tab extending from the top wall at an edge of the window, the tab engaging against the intermediate section of the alignment rib.

2. The electrical terminal of claim 1, wherein the contact further includes a flange extending from a top surface of the body, and the hood includes a window through which the flange extends.

3. The electrical terminal of claim 2, wherein the rear section of the alignment rib has a space formed therein, and the flange is seated within the space.

4. The electrical terminal of claim 1, wherein the intermediate section of the alignment rib has a first wall portion extending upwardly from one of the side walls, a horizontal wall portion extending from an upper end of the first wall portion, an angled wall portion extending from an end of the horizontal wall portion, the angled wall portion extending downwardly toward the top wall.

5. The electrical terminal of claim 4, wherein the angled wall portion has a front end and a rear end, the front end being closer to the side wall from which the intermediate section extends than the rear end.

6. The electrical terminal of claim 1, wherein a front end of the alignment rib is spaced rearwardly from the front end of the body of the hood.

7. The electrical terminal of claim 1, wherein the alignment rib further comprises a finger extending downwardly, and a window in the top wall of the hood, the finger extending into the window.

8. The electrical terminal of claim 1, wherein each contact beam is movable relative to the body of the contact, and further comprising first and second and second stiffening beams extending from the body of the hood and extending into the passageway of the hood, each stiffening beam being movable relative to the body of the hood, the first stiffening beam engaging the first contact beam and the second stiffening beam engaging the second contact beam.

9. The electrical terminal of claim 1, wherein the contact is formed of a first material having a tensile strength, the hood is formed of a second material having a tensile strength, wherein the tensile strength of the second material is greater than the tensile strength of the first material.

10. The electrical terminal of claim 1, wherein the first and second contact beams are aligned with each other and extend from the body proximate to a front end of the body of the contact.

11. The electrical terminal of claim 1, wherein the hood further comprises at least one projection forming a stop provided proximate to the front end of the body of the hood, the at least one projection extending into the passageway of the hood, the front end of the body of the contact engaging against the at least one projection.

12. The electrical terminal of claim 1, further comprising a flange extending outwardly from a front end of each wall of the body of the hood, each flange being formed of a first wall portion and a second wall portion, the second wall portion of the flange being angled at an angle of about 120 degrees to about 180 degrees relative to a centerline of the first wall portion of the flange.

13. The electrical terminal of claim 1, wherein the intermediate section is longitudinally rearward of the first and second contact beams.

14. The electrical terminal of claim 13, wherein the tab engages against a rearward end of the intermediate section of the alignment rib.

15. A combination comprising:

a connector assembly comprising a housing having a passageway extending therethrough, a compliant resilient seal comprising a front end and rear end and a passageway extending therethrough, the seal being rearward of the housing, and a grommet cap comprising a front end and rear end, a passageway extending therethrough, and a keyway extending therethrough and extending from the passageway, the grommet cap being rearward of the seal; and an electrical terminal comprising a contact formed of a body having a front end and a rear end, a passageway formed therethrough, and first and second contact beams extending from the body and extending into the passageway, and a hood surrounding the contact, the hood formed of a body having a top wall, a bottom wall and side walls extending between the top and bottom walls such that a front end and a rear end of the body are defined and a passageway is formed therethrough, an alignment rib extending from the top wall, the alignment rib having a front section which extends partially across a top surface of the top wall a first distance, a rear section which extends partially across the top surface of the top wall a second distance, and an intermediate section which extends partially across the top surface of the top wall a third distance, the intermediate section being between the front and rear sections, wherein the third distance is greater than the first or second distances, a window provided through the top wall, and a tab extending from the top wall at an edge of the window, the tab engaging against the intermediate section of the alignment rib, wherein when the electrical terminal passes through the grommet cap, the alignment rib is accommodated in the keyway and the walls are accommodated in the passageway.

16. The combination of claim 15, wherein each contact beam is movable relative to the body of the contact, and further comprising first and second and second stiffening beams extending from the body of the hood and extending into the passageway of the hood, each stiffening beam being movable relative to the body of the hood, the first stiffening beam engaging the first contact beam and the second stiffening beam engaging the second contact beam.

17. The combination of claim 16, further comprising a lock engageable with the hood, the lock being configured to be locked in position relative to the housing.

18. The combination of claim 17, wherein a front end of the alignment rib is spaced rearwardly from the front end of the body of the hood.

19. A combination comprising:

a connector assembly comprising a housing having a passageway extending therethrough, and a retention finger extending from a wall of the housing into the passageway, a compliant resilient seal comprising a front end and rear end and a passageway extending therethrough, the seal being rearward of the housing, and a grommet cap comprising a front end and rear end, a passageway extending therethrough, the grommet cap being rearward of the seal; and an electrical terminal comprising a contact formed of a body having a front end and a rear end, a passageway formed therethrough, and first and second contact beams extending from the body and extending into the passageway, and a hood surrounding the contact, the hood formed of a body having a top wall, a bottom wall and side walls extending between the top and bottom walls such that a front end and a rear end of the body are defined and a passageway is formed therethrough, an alignment rib extending from the top wall, the alignment rib having a front section which extends partially across a top surface of the top wall a first distance, a rear section which extends partially across the top surface of the top wall a second distance, and an intermediate section which extends partially across the top surface of the top wall a third distance, the intermediate section being between the front and rear sections, wherein the third distance is greater than the first or second distances, a window provided through the top wall, and a tab extending from the top wall at an edge of the window, the tab engaging against the intermediate section of the alignment rib, wherein the retention finger seats within the window and engages against the tab.

20. The combination of claim 19, further comprising a lock engageable with the hood, the lock being configured to be locked in position relative to the housing.

21. A combination comprising:

a connector assembly comprising a housing having a passageway extending therethrough, and a retention finger extending from a wall of the housing into the passageway; and an electrical terminal comprising a contact formed of a body having a front end and a rear end, a passageway formed therethrough, and first and second contact beams extending from the body and extending into the passageway, and a hood surrounding the contact, the hood formed of a body having a top wall, a bottom wall and side walls extending between the top and bottom walls such that a front end and a rear end of the body are defined and a passageway is formed therethrough, an alignment rib extending from the top wall, the alignment rib having a front section which extends partially across a top surface of the top wall a first distance, a rear section which extends partially across the top surface of the top wall a second distance, and an intermediate section which extends partially across the top surface of the top wall a third distance, the intermediate section being between the front and rear sections, wherein the third distance is greater than the first or second distances, a window provided through the top wall, and a tab extending from the top wall at an edge of the window, the tab engaging against the intermediate section of the alignment rib, wherein the retention finger seats within the window and engages against the tab.

22. The combination of claim 21, further comprising a lock engageable with the hood, the lock being configured to be locked in position relative to the housing.

23. The combination of claim 21, further comprising a compliant resilient seal, the seal being rearward of the housing.

* * * * *